US010313820B2

(12) United States Patent
Seldess

(10) Patent No.: US 10,313,820 B2
(45) Date of Patent: Jun. 4, 2019

(54) SUB-BAND SPATIAL AUDIO ENHANCEMENT

(71) Applicant: Boomcloud 360, Inc., Encinitas, CA (US)

(72) Inventor: Zachary Seldess, San Diego, CA (US)

(73) Assignee: Boomcloud 360, Inc., Encinitas, CA (US)

( * ) Notice: Subject to any disclaimer, the term of this patent is extended or adjusted under 35 U.S.C. 154(b) by 80 days.

(21) Appl. No.: 15/646,821

(22) Filed: Jul. 11, 2017

(65) Prior Publication Data

US 2019/0020966 A1 Jan. 17, 2019

(51) Int. Cl.
*H04S 3/00* (2006.01)
*H04S 7/00* (2006.01)

(52) U.S. Cl.
CPC ..... *H04S 7/303* (2013.01); *H04S 3/008* (2013.01); *H04S 2400/01* (2013.01); *H04S 2400/13* (2013.01); *H04S 2420/07* (2013.01)

(58) Field of Classification Search
CPC ..... H04S 7/303
USPC ..... 381/17, 18, 19, 27, 71.1, 300, 303
See application file for complete search history.

(56) References Cited

U.S. PATENT DOCUMENTS 3,920,904 A 11/1975 Blauert et al.
4,910,778 A * 3/1990 Barton ..... H04S 1/002 381/1
2008/0031462 A1 2/2008 Walsh et al.
2008/0165975 A1 7/2008 Oh et al.
(Continued)

FOREIGN PATENT DOCUMENTS

CN 100481722 C 4/2009
CN 101884065 B 7/2013
(Continued)

OTHER PUBLICATIONS

PCT International Search Report and Written Opinion, PCT Application No. PCT/US2017/013061, dated Apr. 18, 2017, 12 pages.
PCT International Search Report and Written Opinion, PCT Application No. PCT/US2017/013249, dated Apr. 18, 2017, 20 pages.
(Continued)

*Primary Examiner* — Yosef K Laekemariam
(74) *Attorney, Agent, or Firm* — Fenwick & West LLP

(57) ABSTRACT

An audio system provides for spatial enhancement of an audio signal including a left input channel and a right input channel. The system may include a spatial frequency band divider, a spatial frequency band processor, and a spatial frequency band combiner. The spatial frequency band divider processes the left input channel and the right input channel into a spatial component and a nonspatial component. The spatial frequency band processor applies subband gains to subbands of the spatial component to generate an enhanced spatial component, and applies subband gains to subbands of the nonspatial component to generate an enhanced nonspatial component. The spatial frequency band combiner combines the enhanced spatial component and the enhanced nonspatial component into a left output channel and a right output channel. In some embodiments, the spatial component and nonspatial component are separated into spatial subband components and nonspatial subband components for the processing.

27 Claims, 22 Drawing Sheets

(56) References Cited

U.S. PATENT DOCUMENTS

| | | | | |
|---|---|---|---|---|
| 2008/0249769 | A1* | 10/2008 | Baumgarte | G10L 25/69 704/227 |
| 2008/0273721 | A1* | 11/2008 | Walsh | H04S 5/00 381/300 |
| 2009/0262947 | A1 | 10/2009 | Karlsson et al. | |
| 2009/0304189 | A1* | 12/2009 | Vinton | H04S 5/00 381/27 |
| 2011/0152601 | A1 | 6/2011 | Puria et al. | |
| 2011/0188660 | A1* | 8/2011 | Xu | H04S 3/002 381/1 |
| 2011/0268281 | A1 | 11/2011 | Florencio et al. | |
| 2012/0099733 | A1 | 4/2012 | Wang et al. | |
| 2012/0328109 | A1 | 12/2012 | Harma et al. | |

FOREIGN PATENT DOCUMENTS

| | | | |
|---|---|---|---|
| CN | 103765507 | B | 1/2016 |
| CN | 102893331 | B | 3/2016 |
| JP | 2012-060599 | A | 3/2012 |
| JP | 2013-013042 | A | 1/2013 |
| KR | 10-0671360 | B1 | 1/2007 |
| KR | 10-2009-0074191 | A | 7/2009 |
| KR | 10-2012-0077763 | A | 7/2012 |
| TW | I484484 | | 5/2015 |
| TW | I489447 | | 6/2015 |
| TW | 201532035 | A | 8/2015 |

OTHER PUBLICATIONS

"Bark scale," Wikipedia.org, Last Modified Jul. 14, 2016, 4 pages, [Online] [Retrieved on Apr. 20, 2017] Retrieved from the Internet<URL:https://en.wikipedia.org/wiki/Bark_scale>.

Taiwan Office Action, Taiwan Application No. 106101748, dated Aug. 15, 2017, 6 pages (with concise explanation of relevance).

Taiwan Office Action, Taiwan Application No. 106101777, dated Aug. 15, 2017, 6 pages (with concise explanation of relevance).

PCT International Search Report and Written Opinion, PCT Application No. PCT/US2018/041128, dated Nov. 9, 2018, 13 pages.

* cited by examiner

SUB-BAND SPATIAL AUDIO ENHANCEMENT

BACKGROUND

Field of the Disclosure

Embodiments of the present disclosure generally relate to the field of audio signal processing and, more particularly, to spatial enhancement of stereo and multi-channel audio produced over loudspeakers.

Description of the Related Art

Stereophonic sound reproduction involves encoding and reproducing signals containing spatial properties of a sound field. Stereophonic sound enables a listener to perceive a spatial sense in the sound field from a stereo signal.

SUMMARY

A subband spatial audio processing method enhances an audio signal including a left input channel and a right input channel. The left input channel and the right input channel are processed into a spatial component and a nonspatial component. First subband gains are applied to subbands of the spatial component to generate an enhanced spatial component, and second subband gains are applied to subbands of the nonspatial component to generate an enhanced nonspatial component. The enhanced spatial component and the enhanced nonspatial component are then combined into a left output channel and a right output channel.

In some embodiments, the processing of the left input channel and the right input channel into the spatial component and the nonspatial component includes processing the left input channel and the right input channel into spatial subband components and nonspatial subband components. The first subband gains can be applied to the subbands of the spatial component by applying the first subband gains to the spatial subband components to generate enhanced spatial subband components. Similarly, the second gains can be applied to the subbands of the nonspatial component by applying the second subband gains to the nonspatial subband components to generate enhanced nonspatial subband components. The enhanced spatial subband components and the enhanced nonspatial subband components can then be combined.

A subband spatial audio processing apparatus for enhancing an audio signal having a left input channel and a right input channel can include a spatial frequency band divider, a spatial frequency band processor, and a spatial frequency band combiner. The spatial frequency band divider processes the left input channel and the right input channel into a spatial component and a nonspatial component. The spatial frequency band processor applies first subband gains to subbands of the spatial component to generate an enhanced spatial component, and applies second subband gains to subbands of the nonspatial component to generate an enhanced nonspatial component. The spatial frequency band combiner combines the enhanced spatial component and the enhanced nonspatial component into a left output channel and a right output channel.

In some embodiments, the spatial frequency band divider processes the left input channel and the right input channel into the spatial component and the nonspatial component by processing the left input channel and the right input channel into spatial subband components and nonspatial subband components. The spatial frequency band processor applies the first subband gains to the subbands of the spatial component to generate the enhanced spatial component by applying the first subband gains to the spatial subband components to generate enhanced spatial subband components. The spatial frequency band processor applies the second subband gains to the subbands of the nonspatial component to generate the enhanced spatial component by applying the second subband gains to the nonspatial subband components to generate enhanced nonspatial subband components. The spatial frequency band combiner combines the enhanced spatial component and the enhanced nonspatial component into the left output channel and the right output channel by combining the enhanced spatial subband components and the enhanced nonspatial subband components.

Some embodiments include a non-transitory computer readable medium to store program code, the program code comprising instructions that when executed by a processor cause the processor to: process a left input channel and a right input channel of an audio signal into a spatial component and a nonspatial component; apply first subband gains to subbands of the spatial component to generate an enhanced spatial component; apply second subband gains to subbands of the nonspatial component to generate an enhanced nonspatial component; and combine the enhanced spatial component and the enhanced nonspatial component into a left output channel and a right output channel.

BRIEF DESCRIPTION OF THE DRAWINGS

FIGS. 1A and 1B, illustrates an example of a stereo audio reproduction system, according to one embodiment.

DETAILED DESCRIPTION

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The Figures (FIG.) and the following description relate to the preferred embodiments by way of illustration only. It should be noted that from the following discussion, alternative embodiments of the structures and methods disclosed herein will be readily recognized as viable alternatives that may be employed without departing from the principles of the present invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments for purposes of illustration only. One skilled in the art will readily recognize from the following description that alternative embodiments of the structures and methods illustrated herein may be employed without departing from the principles described herein.

Example Audio System

Figure 1:
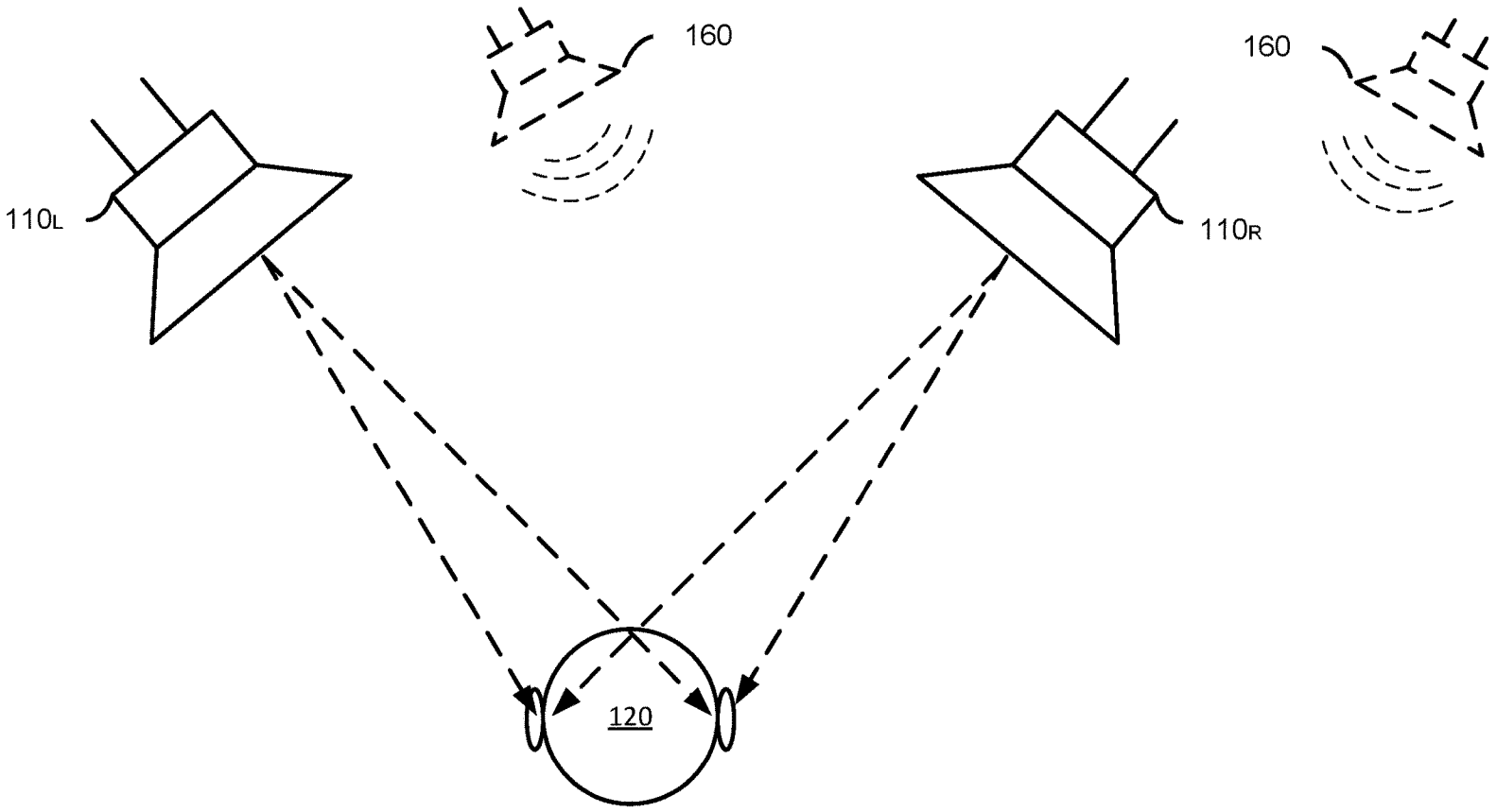
FIG. 1, comprising

FIG. 1 illustrates some principles of stereo audio reproduction. In a stereo configuration, speakers $\mathbf{110}_L$ and $\mathbf{110}_R$ are positioned at fixed locations with respect to a listener 120. The speaker 110 convert a stereo signal comprising left and right audio channels (equivalently, signals) into sound waves, which are directed towards a listener 120 to create an impression of sound heard from an imaginary sound source 160 (e.g., a spatial image), which may appear to be located between loudspeakers $\mathbf{110}_L$ and $\mathbf{110}_R$, or an imaginary source 160 located beyond either of the loudspeakers 110, or any combination of such sources 160. The present disclosure provides various methods for enhancing the perception of such spatial images-processing of the left and right audio channels.

Figure 2:
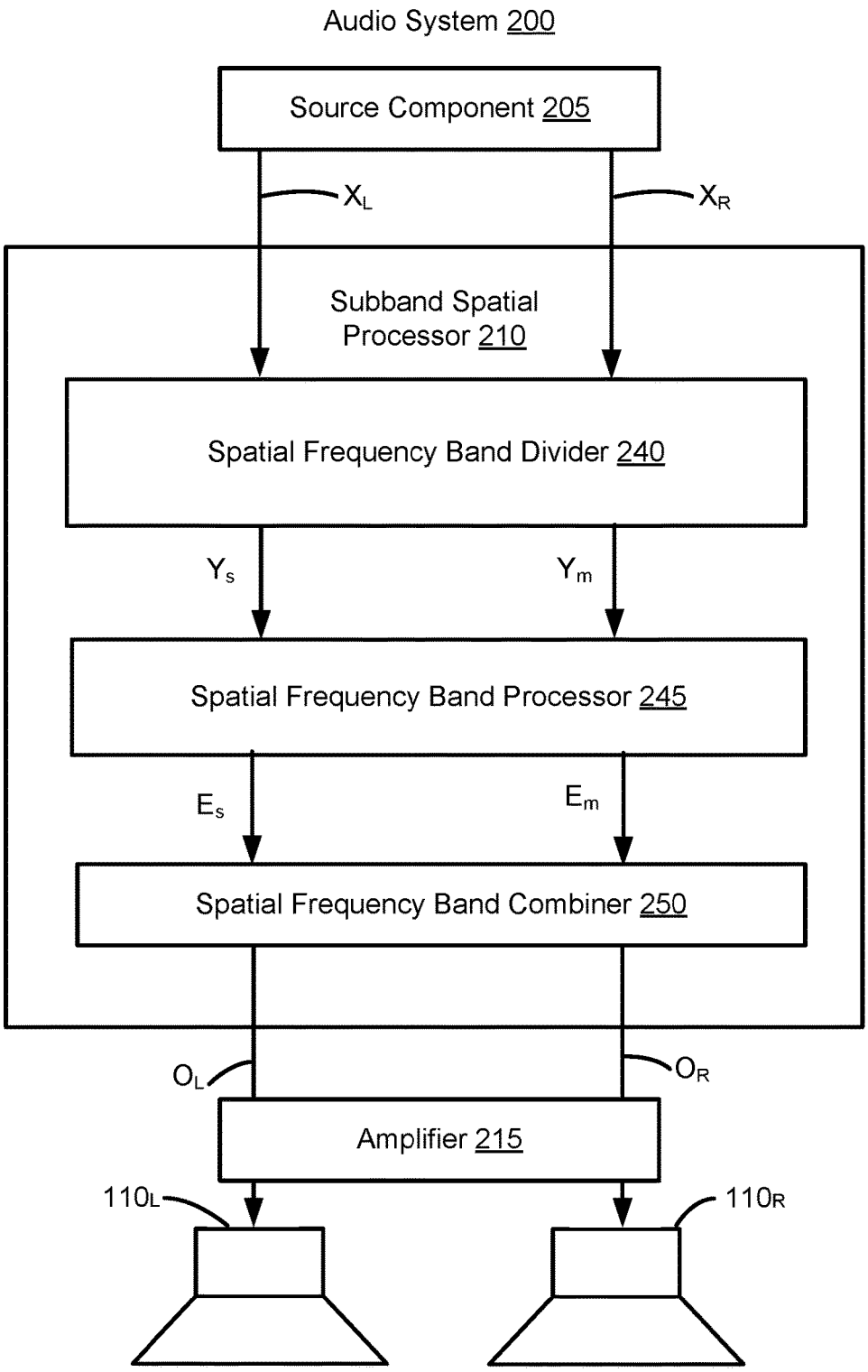
FIG. 2 illustrates an example of an audio system 200 for enhancing an audio signal, according to one embodiment.

FIG. 2 illustrates an example of an audio system 200 in which a subband spatial processor 210 can be used to enhance an audio signal, according to one embodiment. The audio system 200 includes a source component 205 that provides an input audio signal X including two input channels $X_L$ and $X_R$ to the subband spatial processor 210. The source component 205 is a device that provides the input audio signal X in a digital bitstream (e.g., PCM data), and may be a computer, digital audio player, optical disk player (e.g., DVD, CD, Blu-ray), digital audio streamer, or other source of digital audio signals. The subband spatial processor 210 generates an output audio signal O including two output channels $O_L$ and $O_R$ by processing the input channels $X_L$ and $X_R$. The audio output signal O is a spatially enhanced audio signal of the input audio signal X. The subband spatial processor 210 is configured to be coupled to an amplifier 215 in the system 200, which amplifies the signal and provides the signal to output devices, such as the loudspeakers $\mathbf{110}_L$ and $\mathbf{110}_R$, that convert the output channels $O_L$ and $O_R$ into sound. In some embodiments, the output channels $O_L$ and $O_R$ are coupled to another type of speaker, such as headphones, earbuds, integrated speakers of an electronic device, etc.

The subband spatial processor 210 includes a spatial frequency band divider 240, a spatial frequency band processor 245, and a spatial frequency band combiner 250. The spatial frequency band divider 240 is coupled to the input channels $X_L$ and $X_R$ and the spatial frequency band processor 245. The spatial frequency band divider 240 receives the left input channel $X_L$ and the right input channel $X_R$, and processes the input channels into a spatial (or "side") component $Y_s$ and a nonspatial (or "mid") component $Y_m$. For example, the spatial component $Y_s$ can be generated based on a difference between the left input channel $X_L$ and the right input channel $X_R$. The nonspatial component $Y_m$ can be generated based on a sum of the left input channel $X_L$ and the right input channel $X_R$. The spatial frequency band divider 240 provides the spatial component $Y_s$ and the nonspatial component $Y_m$ to the spatial frequency band processor 245.

In some embodiments, the spatial frequency band divider 240 separates the spatial component $Y_s$ into spatial subband components $Y_s(\mathbf{1})$-$Y_s(n)$, where n is a number of frequency subbands. The frequency subbands each includes a range of frequencies, such as 0-300 Hz, 300-510 Hz, 510-2700 Hz, and 2700-Nyquist Hz for n=4 frequency subbands. The spatial frequency band divider 240 also separates the nonspatial component $Y_m$ into nonspatial subband components $Y_m(\mathbf{1})$-$Y_m(n)$, where n is the number of frequency subbands. The spatial frequency band divider 240 provides the spatial subband components $Y_s(\mathbf{1})$-$Y_s(n)$ and the nonspatial subband components $Y_m(\mathbf{1})$-$Y_m(n)$ to the spatial frequency band processor 245 (e.g., instead of the unseparated spatial component $Y_s$ and nonspatial component $Y_m$). FIGS. 3A, 3B, 3C, and 3D illustrate various embodiments of the spatial frequency divider 240.

The spatial frequency band processor 245 is coupled to the spatial frequency band divider 240 and the spatial frequency band combiner 250. The spatial frequency band processor 245 receives the spatial component $Y_s$ and the nonspatial component $Y_m$ from spatial frequency band divider 240, and enhances the received signals. In particular, the spatial frequency band processor 245 generates an enhanced spatial component $E_s$ from the spatial component $Y_s$, and an enhanced nonspatial component $E_m$ from the nonspatial component $Y_m$.

For example, the spatial frequency band processor 245 applies subband gains to the spatial component $Y_s$ to generate the enhanced spatial component $E_s$, and applies subband gains to the nonspatial component $Y_m$ to generate the enhanced nonspatial component $E_m$. In some embodiments, the spatial frequency band processor 245 additionally or alternatively provides subband delays to the spatial component $Y_s$ to generate the enhanced spatial component $E_s$, and subband delays to the nonspatial component $Y_m$ to generate the enhanced nonspatial component $E_m$. The subband gains and/or delays can be different for the different (e.g., n) subbands of the spatial component $Y_s$ and the nonspatial component $Y_m$, or can be the same (e.g., for two or more subbands). The spatial frequency band processor 245 adjusts the gain and/or delays for different subbands of the spatial component $Y_s$ and the nonspatial component $Y_m$ with respect to each other to generate the enhanced spatial component $E_s$ and the enhanced nonspatial component $E_m$. The spatial frequency band processor 245 then provides the enhanced spatial component $E_s$ and the enhanced nonspatial component $E_m$ to the spatial frequency band combiner 250.

Figure 4A:
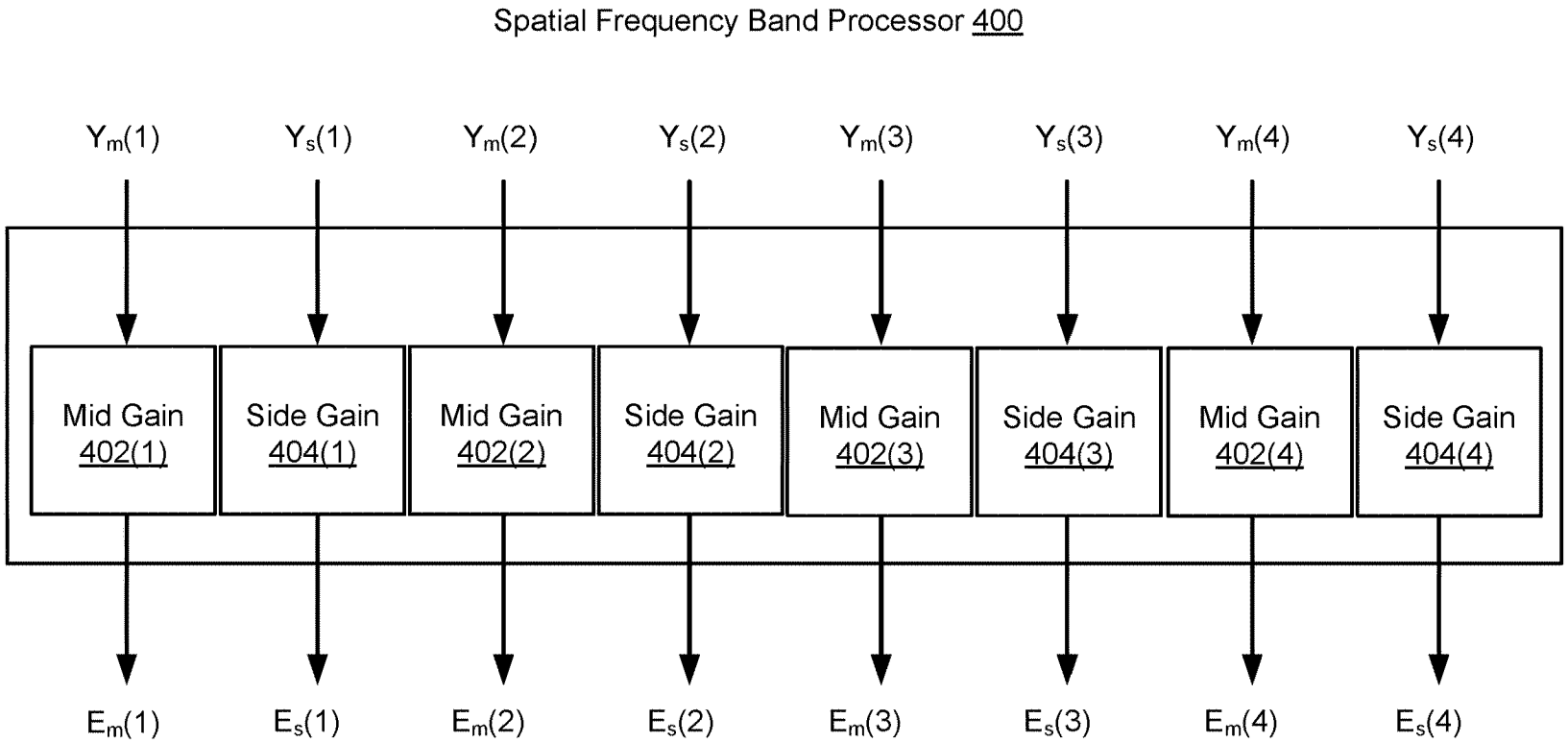
FIG. 4A illustrates an example of a spatial frequency band processor of the audio system, according to some embodiments.
Figure 4B:
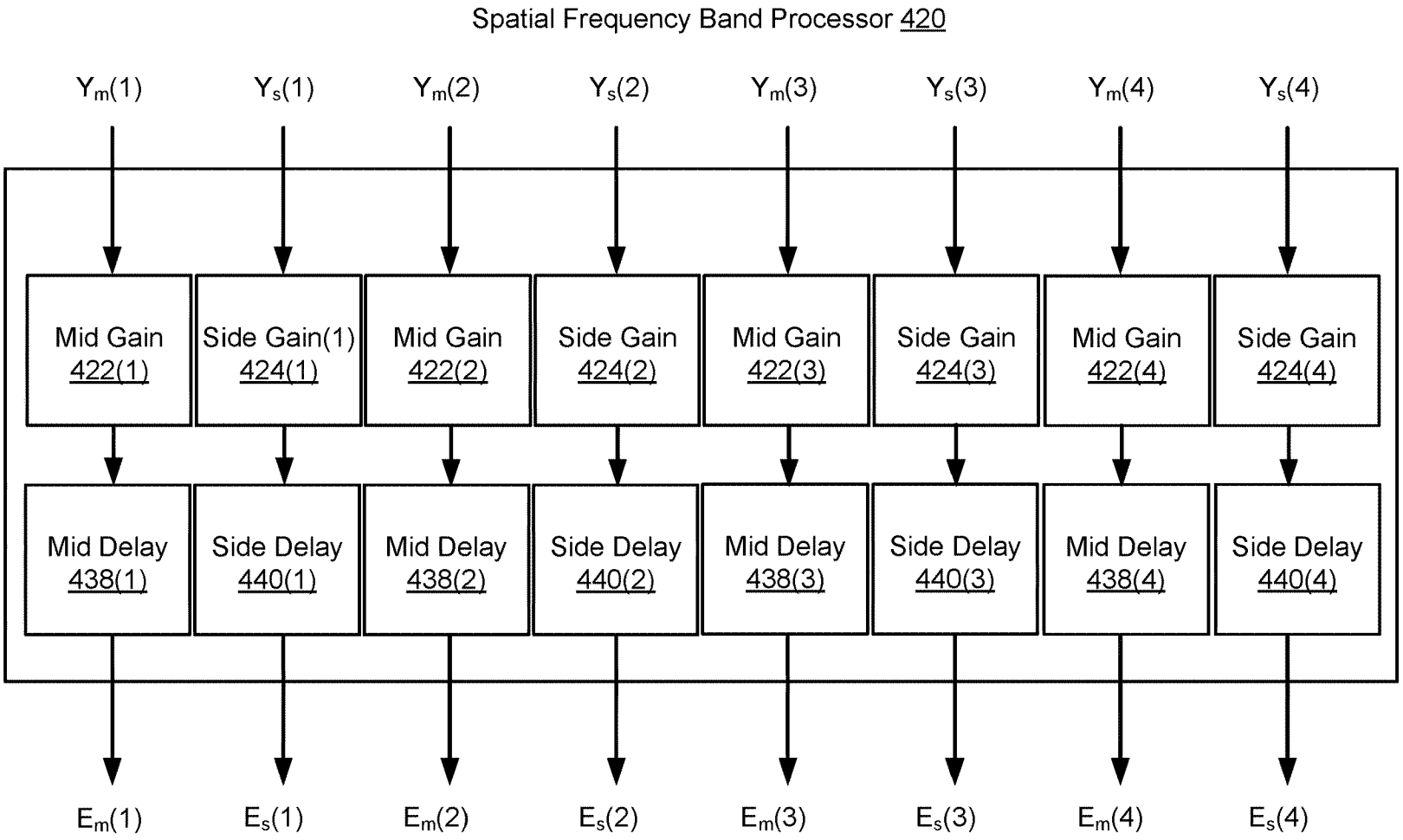
FIG. 4B illustrates an example of a spatial frequency band processor of the audio system, according to some embodiments.
Figure 4C:
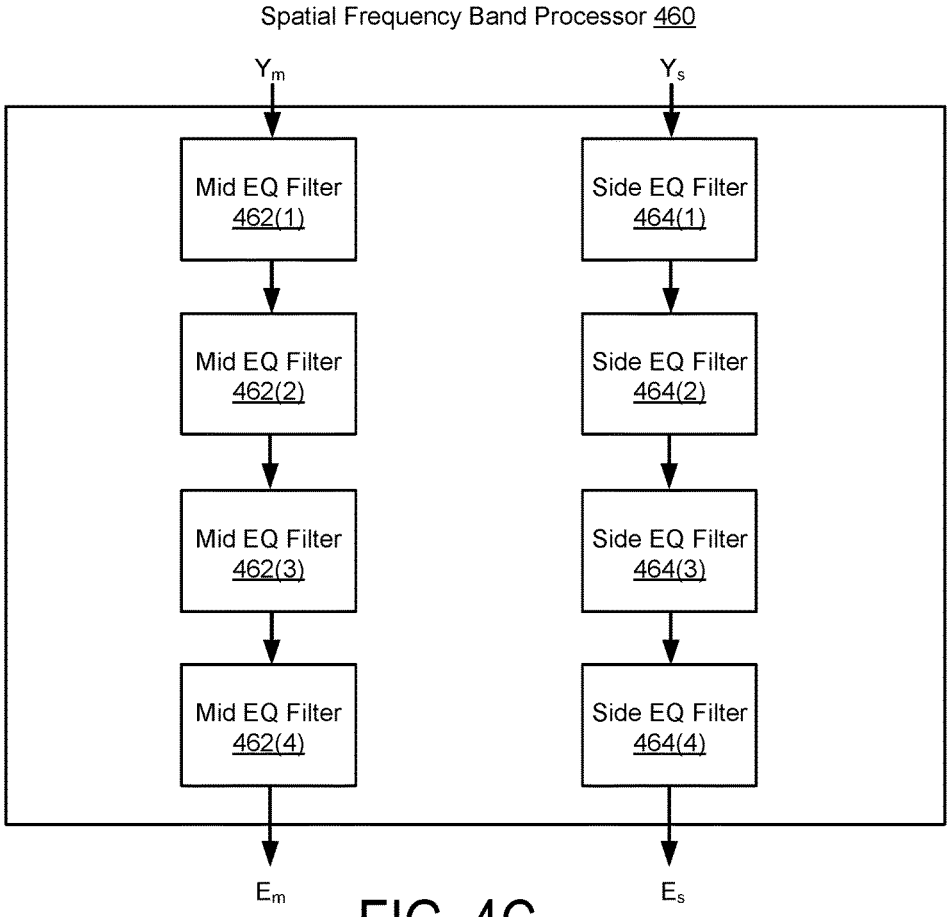
FIG. 4C illustrates an example of a spatial frequency band processor of the audio system, according to some embodiments.

In some embodiments, the spatial frequency band processor 245 receives the spatial subband components $Y_s(1)$-$Y_s(n)$ and the nonspatial subband components $Y_m(1)$-$Y_m(n)$ from the spatial frequency band divider 240 (e.g., instead of the unseparated spatial component $Y_s$ and the nonspatial component $Y_m$). The spatial frequency band processor 245 applies gains and/or delays to the spatial subband components $Y_s(1)$-$Y_s(n)$ to generate enhanced spatial subband components $E_s(1)$-$E_s(n)$, and applies gains and/or delays to the nonspatial subband components $Y_m(1)$-$Y_m(n)$ to generate enhanced nonspatial subband components $E_m(1)$-$E_m(n)$. The spatial frequency band processor 245 provides the enhanced spatial subband components $E_s(1)$-$E_s(n)$ and the enhanced nonspatial subband components $E_m(1)$-$E_m(n)$ to the spatial frequency band combiner 250 (e.g., instead of the unseparated enhanced spatial component $E_s$ and enhanced nonspatial component $E_m$). FIGS. 4A, 4B, and 4C illustrate various embodiments of the spatial frequency band processor 245, including spatial frequency band processors that process the spatial and nonspatial components and that process the spatial and nonspatial components after separation into subband components.

The spatial frequency band combiner 250 is coupled to the spatial frequency band processor 245, and further coupled to amplifier 215. The spatial frequency band combiner 250 receives the enhanced spatial component $E_s$ and the enhanced nonspatial component $E_m$ from the spatial frequency band processor 245, and combines the enhanced spatial component $E_s$ and the enhanced nonspatial component $E_m$ into the left output channel $O_L$ and the right output channel $O_R$. For example, the left output channel $O_L$ can be generated based on a sum of the enhanced spatial component $E_s$ and the enhanced nonspatial component $E_m$, and the right output channel $O_R$ can be generated based on a difference between the enhanced nonspatial component $E_m$ and the enhanced spatial component $E_s$. The spatial frequency band combiner 250 provides the left output channel $O_L$ and the right output channel $O_R$ to amplifier 215, which amplifies and outputs the signals to the left speaker $\mathbf{110}_L$, and the right speaker $\mathbf{110}_R$.

In some embodiments, the spatial frequency band combiner 250 receives the enhanced spatial subband components $E_s(1)$-$E_s(n)$ and the enhanced nonspatial subband components $E_m(1)$-$E_m(n)$ from the spatial frequency band processor 245 (e.g., instead of the unseparated enhanced nonspatial component $E_m$ and enhanced spatial component $E_s$). The spatial frequency band combiner 250 combines the enhanced spatial subband components $E_s(1)$-$E_s(n)$ into the enhanced spatial component $E_s$, and combines the enhanced nonspatial subband components $E_m(1)$-$E_m(n)$ into the enhanced nonspatial component $E_m$. The spatial frequency band combiner 250 then combines the enhanced spatial component $E_s$ and the enhanced nonspatial component $E_m$ into the left output channel $O_L$ and the right output channel $O_R$. FIGS. 5A, 5B, 5C, and 5D illustrate various embodiments of the spatial frequency band combiner 250.

Figure 3A:
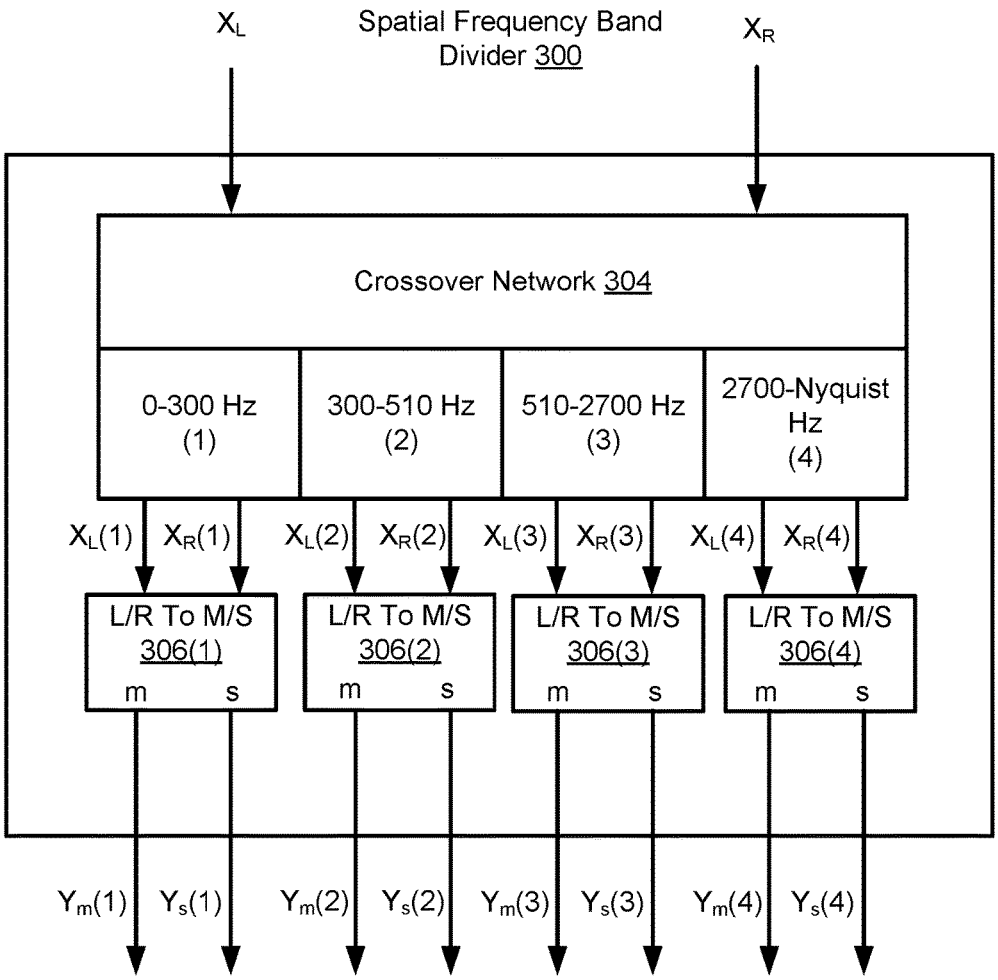
FIG. 3A illustrates an example of a spatial frequency band divider of the audio system, according to some embodiments.

FIG. 3A illustrates a first example of a spatial frequency band divider 300, as an implementation of the spatial frequency band divider 240 of the subband spatial processor 210. Although the spatial frequency band divider 300 uses four frequency subbands (1)-(4) (e.g., n=4), other numbers of frequency subbands can be used in various embodiments. The spatial frequency band divider 300 includes a crossover network 304 and L/R to M/S converters 306(1) though 306(4).

The crossover network 304 divides the left input channel $X_L$ into left frequency subbands $X_L(1)$-$X_L(n)$, and divides the right input channel $X_R$ into right frequency subbands $X_R(1)$-$X_R(n)$, where n is the number of frequency subbands. The crossover network 304 may include multiple filters arranged in various circuit topologies, such as serial, parallel, or derived. Example filter types included in the crossover network 304 include infinite impulse response (IIR) or finite impulse response (FIR) bandpass filters, IIR peaking and shelving filters, Linkwitz-Riley (L-R) filters, etc. In some embodiments, n bandpass filters, or any combinations of low pass filter, bandpass filter, and a high pass filter, are employed to approximate the critical bands of the human ear. A critical band may correspond to the bandwidth within which a second tone is able to mask an existing primary tone. For example, each of the frequency subbands may correspond to a consolidated Bark scale to mimic critical bands of human hearing.

For example, the crossover network 304 divides the left input channel $X_L$ into the left subband components $X_L(1)$-$X_L(4)$, corresponding to 0 to 300 Hz for frequency subband (1), 300 to 510 Hz for frequency subband (2), 510 to 2700 Hz for frequency subband (3), and 2700 to Nyquist frequency for frequency subband (4) respectively, and similarly divides the right input channel $X_R$ into the right subband components $X_R(1)$-$X_R(4)$ for corresponding frequency subbands (1)-(4). In some embodiments, the consolidated set of critical bands is used to define the frequency subbands. The critical bands may be determined using a corpus of audio samples from a wide variety of musical genres. A long term average energy ratio of mid to side components over the 24 Bark scale critical bands is determined from the samples. Contiguous frequency bands with similar long term average ratios are then grouped together to form the set of critical bands. The crossover network 304 outputs pairs of the left subband components $X_L(1)$-$X_L(4)$ and the right subband components $X_R(1)$-$X_R(4)$ to corresponding L/R to M/S converters 306(1)-306(4). In other embodiment, the crossover network 304 can separate the left and right input channels $X_L$, $X_R$ into fewer or greater than four frequency subbands. The range of frequency subbands may be adjustable.

The spatial frequency band divider 300 further includes n L/R to M/S converters 306(1)-306(*n*). In FIG. 3A, spatial frequency band divider 300 uses n=4 frequency subbands, and thus the spatial frequency band divider 300 includes four L/R to M/S converters 306(1)-306(4). Each L/R to M/S converter 306(*k*) receives a pair of subband components $X_L(k)$ and $X_R(k)$ for a given frequency subband k, and converts these inputs into a spatial subband component $Y_m(k)$ and a nonspatial subband component $Y_s(k)$. Each nonspatial subband component $Y_m(k)$ may be determined based on a sum of a left subband component $X_L(k)$ and a right subband component $X_R(k)$, and each spatial subband component $Y_s(k)$ may be determined based on a difference between the left subband component $X_L(k)$ and the right subband component $X_R(k)$. Performing such computations for each subband k, the L/R to M/S converters 306(1)-306(*n*) generate the nonspatial subband components $Y_m(1)$-$Y_m(n)$ and the spatial subband components $Y_s(1)$-$Y_s(n)$ from the left subband components $X_L(1)$-$X_L(n)$ and the right subband components $X_R(1)$-$X_R(n)$.

Figure 3B:
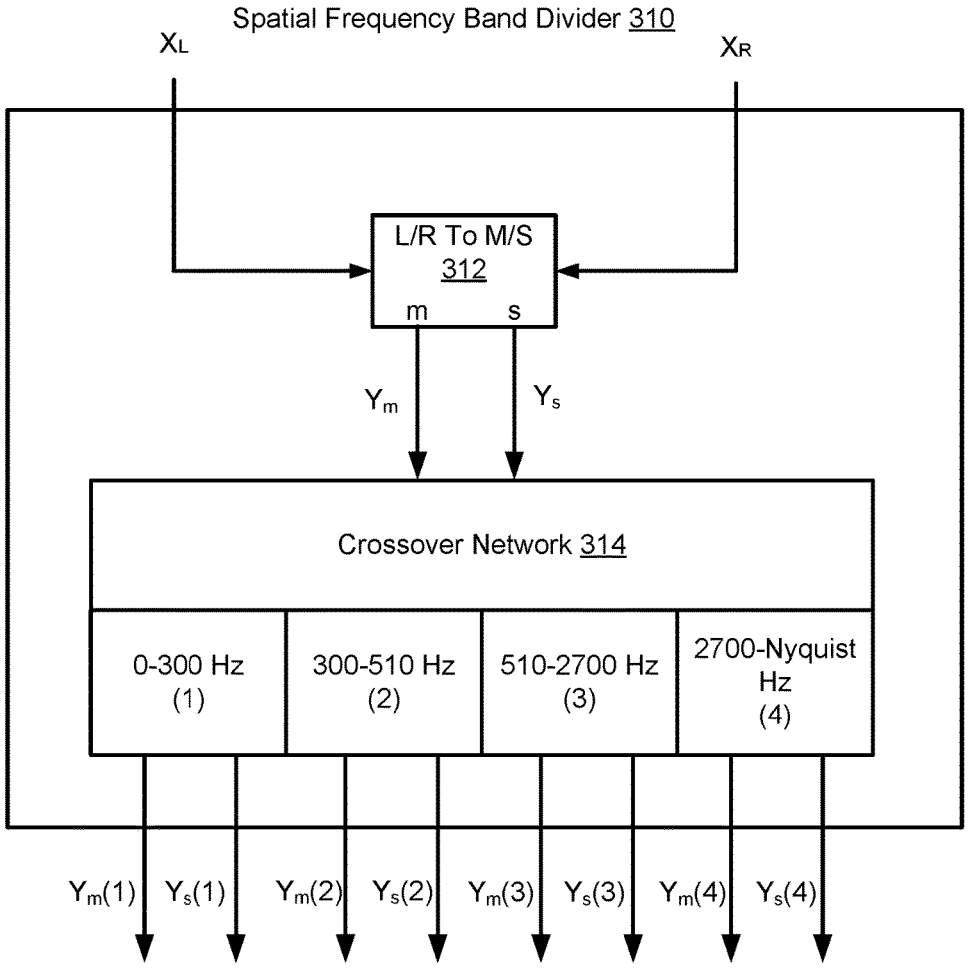
FIG. 3B illustrates an example of a spatial frequency band divider of the audio system, according to some embodiments.

FIG. 3B illustrates a second example of a spatial frequency band divider 310, as an implementation of the spatial frequency band divider 240 of the subband spatial processor 210. Unlike the spatial frequency band divider 300 of FIG. 3A, the spatial frequency band divider 310 performs L/R to M/S conversion first and then divides the output of the L/R to M/S conversion into the nonspatial subband components $Y_m(1)$-$Y_m(n)$ and the spatial subband components $Y_s(1)$-$Y_s(n)$.

Performing the L/R to M/S conversion and then separating the nonspatial component $Y_m$ into the nonspatial subband components $Y_m(1)$-$Y_m(n)$ and the spatial component $Y_s$ into the spatial subband components $Y_s(1)$-$Y_s(n)$ can be computationally more efficient than separating the input signal into left and right subband components $X_L(1)$-$X_L(n)$, $X_R(1)$-$X_R(n)$ and then performing L/R to M/S conversion on each of the subband components. For example, the spatial frequency band divider 310 performs only one L/R to M/S conversion rather than the n L/R to M/S conversions (e.g., one for each frequency subband) performed by the spatial frequency band divider 300.

More specifically, the spatial frequency band divider 310 includes an L/R to M/S converter 312 coupled to a crossover network 314. The L/R to M/S converter 312 receives the left input channel $X_L$ and the right input channel $X_R$, and converts these inputs into the spatial component $Y_s$ and the nonspatial component $Y_m$. The crossover network 314 receives the spatial component $Y_s$ and the nonspatial component $Y_m$ from the L/R to M/S converter 312, and separates these inputs into the spatial subband components $Y_s(1)$-$Y_s(n)$ and the nonspatial subband components $Y_m(1)$-$Y_m(n)$. The operation of crossover network 314 is similar to network 304 in that it can employ a variety of different filter topologies and number of filters.

Figure 3C:
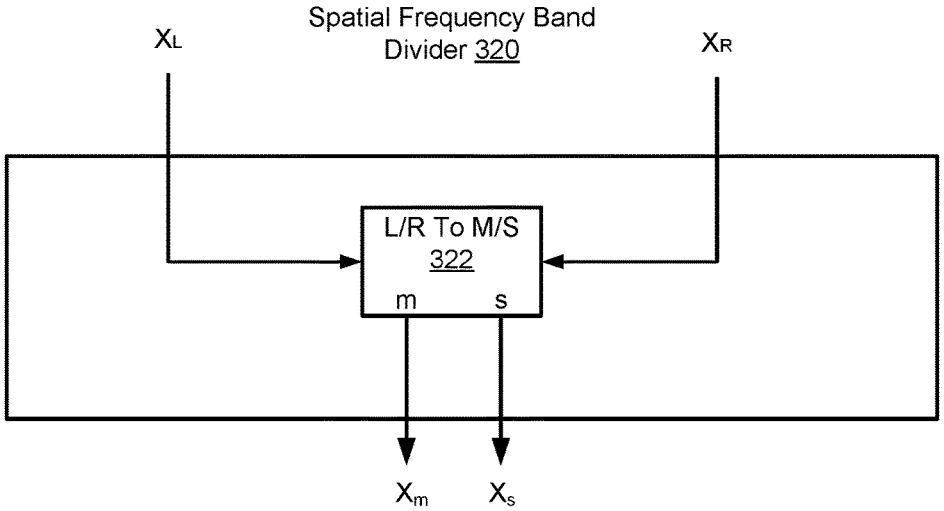
FIG. 3C illustrates an example of a spatial frequency band divider of the audio system, according to some embodiments.

FIG. 3C illustrates a third example of a spatial frequency band divider 320 as an implementation of the spatial frequency band divider 240 of the subband spatial processor 210. The spatial frequency band divider 320 includes an L/S to M/S converter 322 that receives the left input channel $X_L$ and the right input channel $X_R$, and converts these inputs into the spatial component $Y_s$ and the nonspatial component $Y_m$. Unlike the spatial frequency band dividers 300 and 310 shown in FIGS. 3A and 3B, the spatial frequency band divider 320 does not include a crossover network. As such, the spatial frequency band divider 320 outputs the spatial component $Y_s$ and the nonspatial component $Y_m$ without being separated into subband components.

Figure 3D:
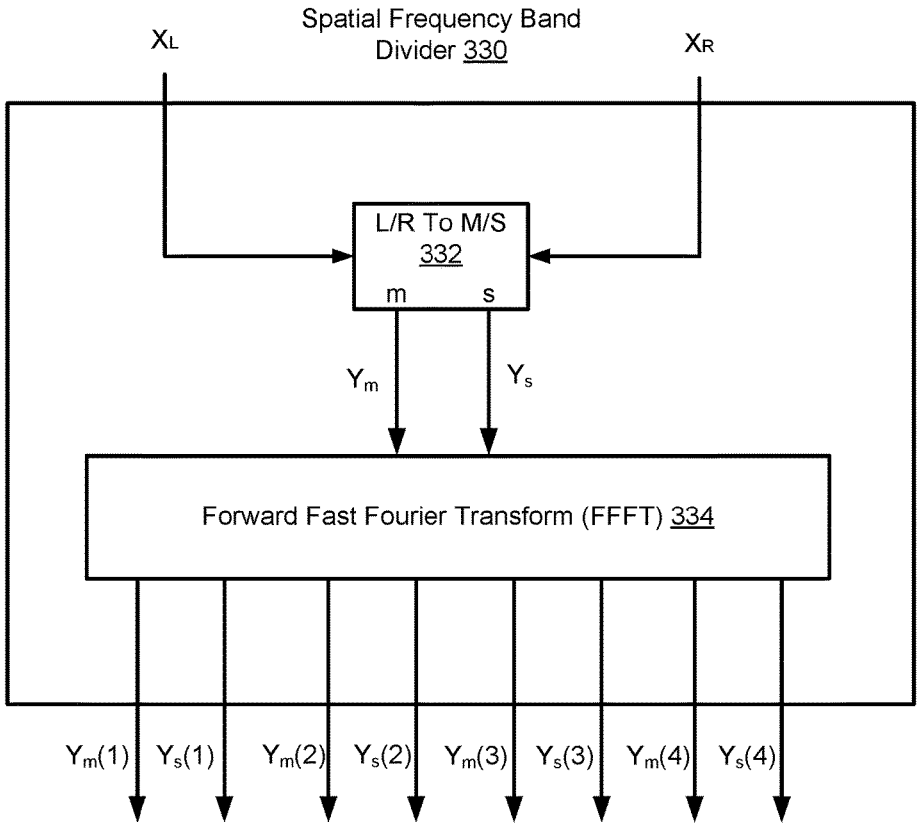
FIG. 3D illustrates an example of a spatial frequency band divider of the audio system, according to some embodiments.

FIG. 3D illustrates a fourth example of a spatial frequency band divider 330, as an implementation of the spatial frequency band divider 240 of the subband spatial processor 210. The spatial frequency band divider 330 facilitates frequency domain enhancement of the input audio signal. The spatial frequency band divider 330 includes a forward fast Fourier transform (FFFT) 334 to generate the spatial subband components $Y_s(1)$-$Y_s(n)$ and the nonspatial subband components $Y_m(1)$-$Y_m(n)$ as represented in the frequency domain.

A frequency domain enhancement may be preferable in designs where many parallel enhancement operations are desired (e.g., independently enhancing 512 subbands vs. only 4 subbands), and where the additional latency introduced from the forward/inverse Fourier Transforms poses no practical issue.

More specifically, the spatial frequency band divider 330 includes an L/R to M/S converter 332 and the FFFT 334. The L/R to M/S converter 332 receives the left input channel $X_L$ and the right input channel $X_R$, and converts these inputs into the spatial component $Y_s$ and the nonspatial component $Y_m$. The FFFT 334 receives the spatial component $Y_s$ and the nonspatial component $Y_m$, and converts these inputs into the spatial subband components $Y_s(1)$-$Y_s(n)$ and the nonspatial subband components $Y_m(1)$-$Y_m(n)$. For n=4 frequency subbands, the FFFT 334 converts the spatial component $Y_s$ and the nonspatial component $Y_m$ in the time domain into the frequency domain. The FFFT 334 then separates the frequency domain spatial component $Y_s$ according to the n frequency subbands to generate the spatial subband components $Y_s(1)$-$Y_s(4)$, and separate the frequency domain nonspatial component $Y_m$ according to the n frequency subbands to generate the nonspatial subband components $Y_m(1)$-$Y_m(4)$.

FIG. 4A illustrates a first example of a spatial frequency band processor 400, as an implementation of the frequency band processor 245 of the subband spatial processor 210. The spatial frequency band processor 400 includes amplifiers that receive the spatial subband components $Y_s(1)$-$Y_s(n)$ and the nonspatial subband components $Y_m(1)$-$Y_m(n)$, and apply subband gains to the spatial subband components $Y_s(1)$-$Y_s(n)$ and the nonspatial subband components $Y_m(1)$-$Y_m(n)$.

More specifically, for example, the spatial frequency band processor 400 includes 2n amplifiers (equivalently "gains," as shown in the Figures), where n=4 frequency subbands. The spatial frequency band processor 400 includes a mid gain 402(1) and a side gain 404(1) for the frequency subband (1), a mid gain 402(2) and a side gain 404(2) for the frequency subband (2), a mid gain 402(3) and a side gain 404(3) for the frequency subband (3), and a mid gain 402(4) and a side gain 404(4) for the frequency subband (4).

The mid gain 402(1) receives the nonspatial subband components $Y_m(1)$ and applies a subband gain to generate the enhanced nonspatial subband components $E_m(1)$. The side gain 404(1) receives the spatial subband component $Y_s(1)$ and applies a subband gain to generate the enhanced spatial subband components $E_s(1)$.

The mid gain 402(2) receives the nonspatial subband components $Y_m(2)$ and applies a subband gain to generate the enhanced nonspatial subband components $E_m(2)$. The side gain 404(2) receives the spatial subband component $Y_s(2)$ and applies a subband gain to generate the enhanced spatial subband components $E_s(2)$.

The mid gain 402(3) receives the nonspatial subband components $Y_m(3)$ and applies a subband gain to generate the enhanced nonspatial subband components $E_m(3)$. The side gain 404(3) receives the spatial subband component $Y_s(3)$ and applies a subband gain to generate the enhanced spatial subband components $E_s(3)$.

The mid gain 402(4) receives the nonspatial subband component $Y_m$(4) and applies a subband gain to generate the enhanced nonspatial subband component $E_m$(4). The side gain 404(4) receives the spatial subband component $Y_s$(4) and applies a subband gain to generate the enhanced spatial subband components $E_s$(4).

The gains 402, 404 adjust the relative subband gains of spatial and nonspatial subband components to provide audio enhancement. The gains 402, 404 may apply different amount of subband gains, or the same amount of subband gains (e.g., for two or more amplifiers) for the various subbands, using gain values controlled by configuration information, adjustable settings, etc. One or more amplifiers can also apply no subband gain (e.g., 0 dB), or negative gain. In this embodiment, the gains 402, 404 apply the subband gains in parallel.

FIG. 4B illustrates a second example of a spatial frequency band processor 420, as an implementation of the frequency band processor 245 of the subband spatial processor 210. Like the spatial frequency band processor 400 shown in FIG. 4A, the spatial frequency band processor 420 includes gain 422, 424 that receive the spatial subband components $Y_s$(1)-$Y_s$(n) and the nonspatial subband components $Y_m$(1)-$Y_m$(n), and applies gains to the spatial subband components $Y_s$(1)-$Y_s$(n) and the nonspatial subband components $Y_m$(1)-$Y_m$(n). The spatial frequency band processor 420 further includes delay units that add adjustable time delays.

More specifically, the spatial frequency band processor 420 may include 2n delay units 438, 440, each delay unit 438, 440 coupled to a corresponding one of 2n gains 422, 424. For example, the spatial frequency band processor 400 includes (e.g., for n=4 subbands) a mid gain 422(1) and a mid delay unit 438(1) to receive the nonspatial subband component $Y_m$(1) and generate the enhanced nonspatial subband component $Y_m$(1) by applying a subband gain and a time delay. The spatial frequency band processor 420 further includes a side gain 424(1) and a side delay unit 440(1) to receive the spatial subband component $Y_s$(1) and generate the enhanced spatial subband component $E_s$(1). Similarly for other subbands, the spatial frequency band processor includes a mid gain 422(2) and a mid delay unit 438(2) to receive the nonspatial subband component $Y_m$(2) and generate the enhanced nonspatial subband component $E_m$(2), a side gain 424(2) and a side delay unit 440(2) to receive the spatial subband component $Y_s$(2) and generate the enhanced spatial subband component $E_s$(2), a mid gain 422(3) and a mid delay unit 438(3) to receive the nonspatial subband component $Y_m$(3) and generate the enhanced nonspatial subband component $E_m$(3), a side gain 424(3) and a side delay unit 440(3) to receive the spatial subband component $Y_s$(3) and generate the enhanced spatial subband component $E_s$(3), a mid gain 422(4) and a mid delay unit 438(4) to receive the nonspatial subband component $Y_m$(4) and generate the enhanced nonspatial subband component $E_m$(4), and a side gain 424(4) and side delay unit 440(4) to receive the spatial subband component $Y_s$(4) and generate the enhanced spatial subband component $E_s$(4).

The gains 422, 424 adjust the subband gains of the spatial and nonspatial subband components relative to each other to provide audio enhancement. The gains 422, 424 may apply different subband gains, or the same subband gains (e.g., for two or more amplifiers) for the various subbands, using gain values controlled by configuration information, adjustable settings, etc. One or more of the amplifiers can also apply no subband gain (e.g., 0 dB). In this embodiment, the amplifiers 422, 424 also apply the subband gains in parallel with respect to each other.

The delay units 438, 440 adjust the timing of spatial and nonspatial subband components relative to each other to provide audio enhancement. The delay units 438, 440 may apply different time delays, or the same time delays (e.g., for two or more delay units) for the various subbands, using delay values controlled by configuration information, adjustable settings, etc. One or more delay units can also apply no time delay. In this embodiment, the delay units 438, 440 apply the time delays in parallel.

FIG. 4C illustrates a third example of a spatial frequency band processor 460, as an implementation of the frequency band processor 245 of the subband spatial processor 210. The spatial frequency band processor 460 receives the nonspatial subband component $Y_m$ and applies a set of subband filters to generate the enhanced nonspatial subband component $E_m$. The spatial frequency band processor 460 also receives the spatial subband component $Y_s$ and applies a set of subband filters to generate the enhanced nonspatial subband component $E_m$. As illustrated in FIG. 4C, these filters are applied in series. The subband filters can include various combinations of peak filters, notch filters, low pass filters, high pass filters, low shelf filters, high shelf filters, bandpass filters, bandstop filters, and/or all pass filters.

More specifically, the spatial frequency band processor 460 includes a subband filter for each of the n frequency subbands of the nonspatial component $Y_m$ and a subband filter for each of the n subbands of the spatial component $Y_s$. For n=4 subbands, for example, the spatial frequency band processor 460 includes a series of subband filters for the nonspatial component $Y_m$ including a mid equalization (EQ) filter 462(1) for the subband (1), a mid EQ filter 462(2) for the subband (2), a mid EQ filter 462(3) for the subband (3), and a mid EQ filter 462(4) for the subband (4). Each mid EQ filter 462 applies a filter to a frequency subband portion of the nonspatial component $Y_m$ to process the nonspatial component $Y_m$ in series and generate the enhanced nonspatial component $E_m$.

The spatial frequency band processor 460 further includes a series of subband filters for the frequency subbands of the spatial component $Y_s$, including a side equalization (EQ) filter 464(1) for the subband (1), a side EQ filter 464(2) for the subband (2), a side EQ filter 464(3) for the subband (3), and a side EQ filter 464(4) for the subband (4). Each side EQ filter 464 applies a filter to a frequency subband portion of the spatial component $Y_s$ to process the spatial component $Y_s$ in series and generate the enhanced spatial component $E_s$.

In some embodiments, the spatial frequency band processor 460 processes the nonspatial component $Y_m$ in parallel with processing the spatial component $Y_s$. The n mid EQ filters process the nonspatial component $Y_m$ in series and the n side EQ filters process the spatial component $Y_s$ in series. Each series of n subband filters can be arranged in different orders in various embodiments.

Using a serial (e.g., cascaded) EQ filter design in parallel on the spatial component $Y_s$ and nonspatial component $Y_m$, as shown by the spatial frequency band processor 460, can provide advantages over a crossover network design where separated subband components are processed in parallel. Using the serial EQ filter design, it is possible to achieve greater control over the subband portion being addressed, such as by adjusting the Q factor and center frequency of a $2^{nd}$ order filter (e.g., peaking/notching or shelving filter, for example). Achieving comparable isolation and control over the same region of the spectrum using a crossover network design may require using higher order filters, such as $4^{th}$ or higher order lowpass/highpass filters. This can result in at least a doubling of the computational cost. Using a crossover network design, subband frequency ranges should have minimal or no overlap in order to reproduce the full-band spectrum after recombining the subband components. Using a serial EQ filter design can remove this constraint on the frequency band relationship from one filter to the next. The serial EQ filter design can also provide for more efficient selective processing on one or more subbands compared to the crossover network design. For example, when employing a subtractive crossover network, the input signal for a given band can be derived by subtracting the original full-band signal from the resulting lowpassed output signal of the lower-neighbor band. Here, isolating a single subband component includes computation of multiple subband components. The serial EQ filters provides for efficient enabling and disabling of filters. However, the parallel design, where the signal is divided into independent frequency subbands, makes possible discrete non-scaling operations on each subband, such as incorporating time delay.

Figure 5A:
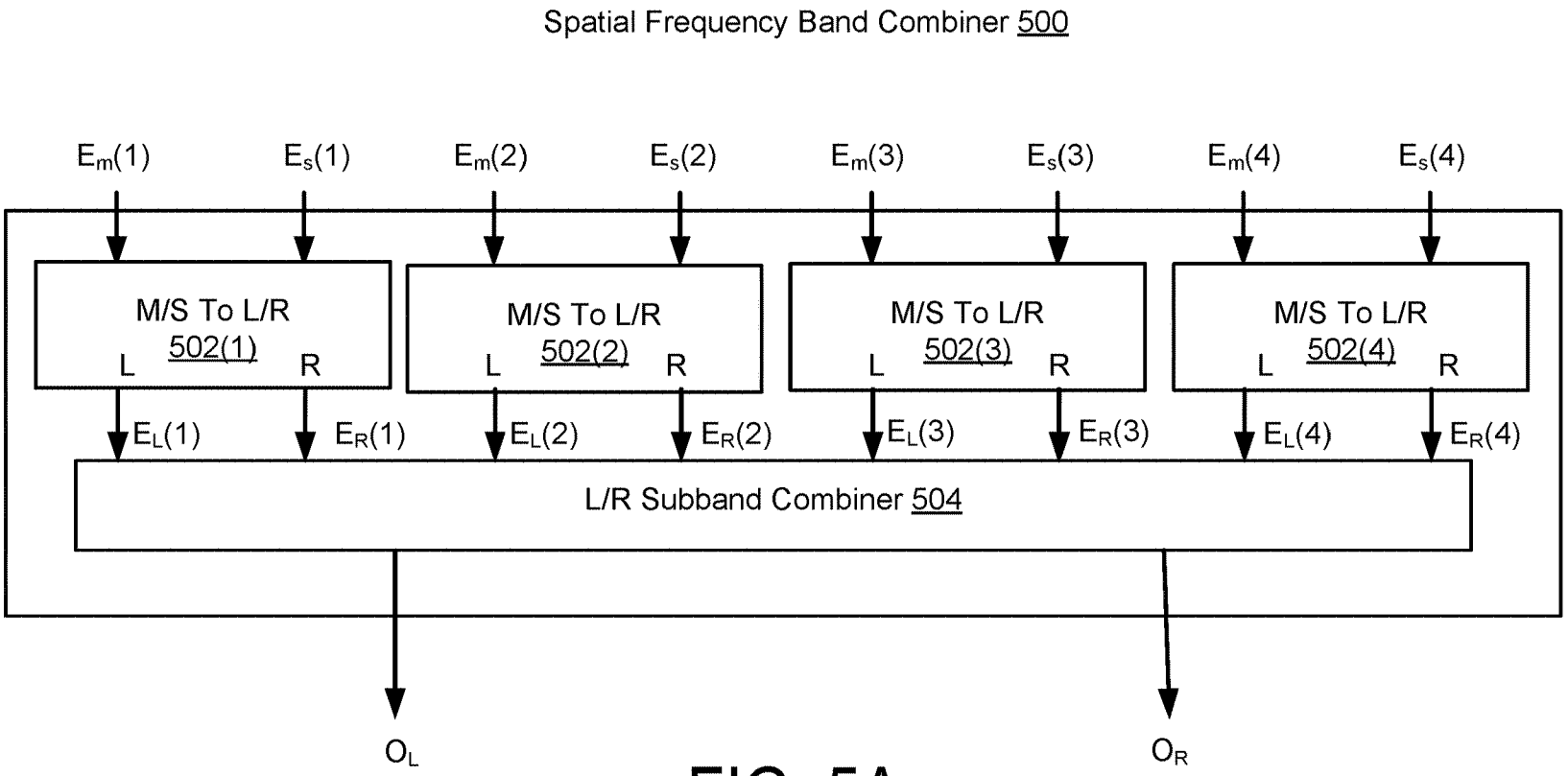
FIG. 5A illustrates an example of a spatial frequency band combiner of the audio system, according to some embodiments.

FIG. 5A illustrates a first example of a spatial frequency band combiner 500, as an implementation of the frequency band combiner 250 of the subband spatial processor 210. The spatial frequency band combiner 500 includes n M/S to L/R converters, such as the M/S to L/R converters 502(1), 502(2), 502(3) and 502(4) for n=4 frequency subbands. The spatial frequency band combiner 500 further includes an L/R subband combiner 504 coupled to the M/S to L/R converters.

For a given frequency subband k, each M/S to L/R converter 502(*k*) receives an enhanced nonspatial subband component $E_m(k)$ and an enhanced spatial subband component $E_s(k)$, and converts these inputs into an enhanced left subband component $E_L(k)$ and an enhanced right subband component $E_R(k)$. The enhanced left subband component $E_L(k)$ can be generated based on a sum of the enhanced nonspatial subband component $E_m(k)$ and the enhanced spatial subband component $E_s(k)$. The enhanced right subband component $E_R(k)$ can be generated based on a difference between the enhanced nonspatial subband component $E_m(k)$ and the enhanced spatial subband component $E_s(k)$.

For n=4 frequency subbands, the L/R subband combiner 504 receives the enhanced left subband components $E_L(\mathbf{1})$-$E_L(\mathbf{4})$, and combines these inputs into the left output channel $O_L$. The L/R subband combiner 504 further receives the enhanced right subband components $E_R(\mathbf{1})$-$E_R(\mathbf{4})$, and combines these inputs into the right output channel $O_R$.

Figure 5B:
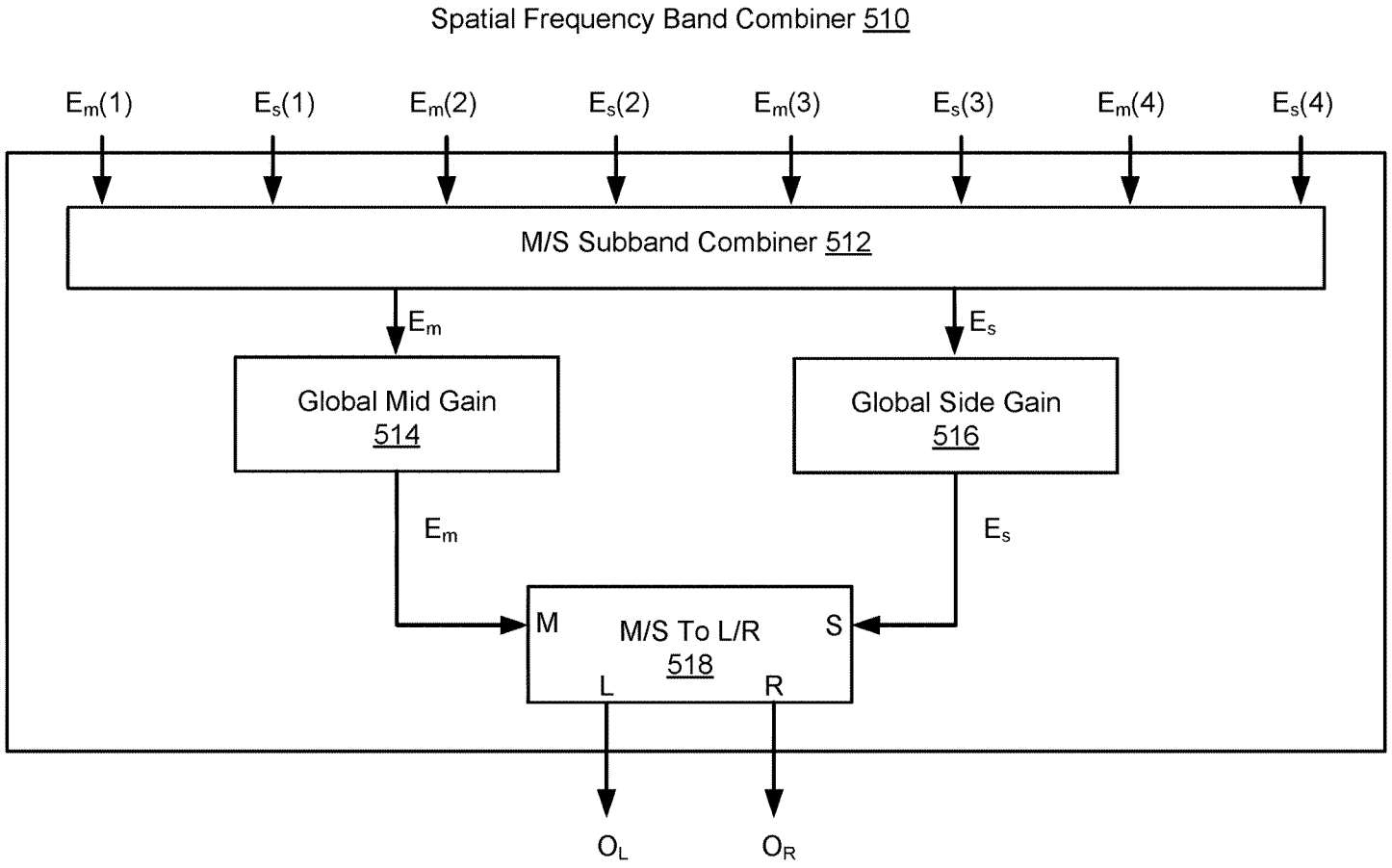
FIG. 5B illustrates an example of a spatial frequency band combiner of the audio system, according to some embodiments.

FIG. 5B illustrates a second example of a spatial frequency band combiner 510, as an implementation of the frequency band combiner 250 of the subband spatial processor 210. Compared to the spatial frequency band combiner 500 shown in FIG. 5A, the spatial frequency band combiner 510 here first combines the enhanced nonspatial subband components $E_m(\mathbf{1})$-$E_m(n)$ into the enhanced nonspatial component $E_m$ and combines the enhanced spatial subband components $E_s(\mathbf{1})$-$E_s(n)$ into the enhanced spatial component $E_s$, and then performs M/S to L/R conversion to generate the left output channel $O_L$ and the right output channel $O_R$. Prior to M/S to L/R conversion, a global mid gain can be applied to the enhanced nonspatial component $E_m$ and a global side gain can be applied to the enhanced spatial component $E_s$, where the global gain values can be controlled by configuration information, adjustable settings, etc.

More specifically, the spatial frequency band combiner 510 includes an M/S subband combiner 512, a global mid gain 514, a global side gain 516, and an M/S to L/R converter 518. For n=4 frequency subbands, the M/S subband combiner 512 receives the enhanced nonspatial subband components $E_m(\mathbf{1})$-$E_m(\mathbf{4})$ and combines these inputs into the enhanced nonspatial component $E_m$. The M/S subband combiner 512 also receives the enhanced spatial subband components $E_s(\mathbf{1})$-$E_s(\mathbf{4})$ and combines these inputs into the enhanced spatial component $E_s$.

The global mid gain 514 and the global side gain 516 are coupled to the M/S subband combiner 512 and the M/S to L/R converter 518. The global mid gain 514 applies a gain to the enhanced nonspatial component $E_m$ and the global side gain 516 applies a gain to the enhanced spatial component $E_s$.

The M/S to L/R converter 518 receives the enhanced nonspatial component $E_m$ from the global mid gain 514 and the enhanced spatial component $E_s$ from the global side gain 516, and converts these inputs into the left output channel $O_L$ and the right output channel $O_R$. The left output channel $O_L$ can be generated based on a sum of the enhanced spatial component $E_s$ and the enhanced nonspatial component $E_m$, and the right output channel $O_R$ can be generated based on a difference between the enhanced nonspatial component $E_m$ and the enhanced spatial component $E_s$.

Figure 5C:
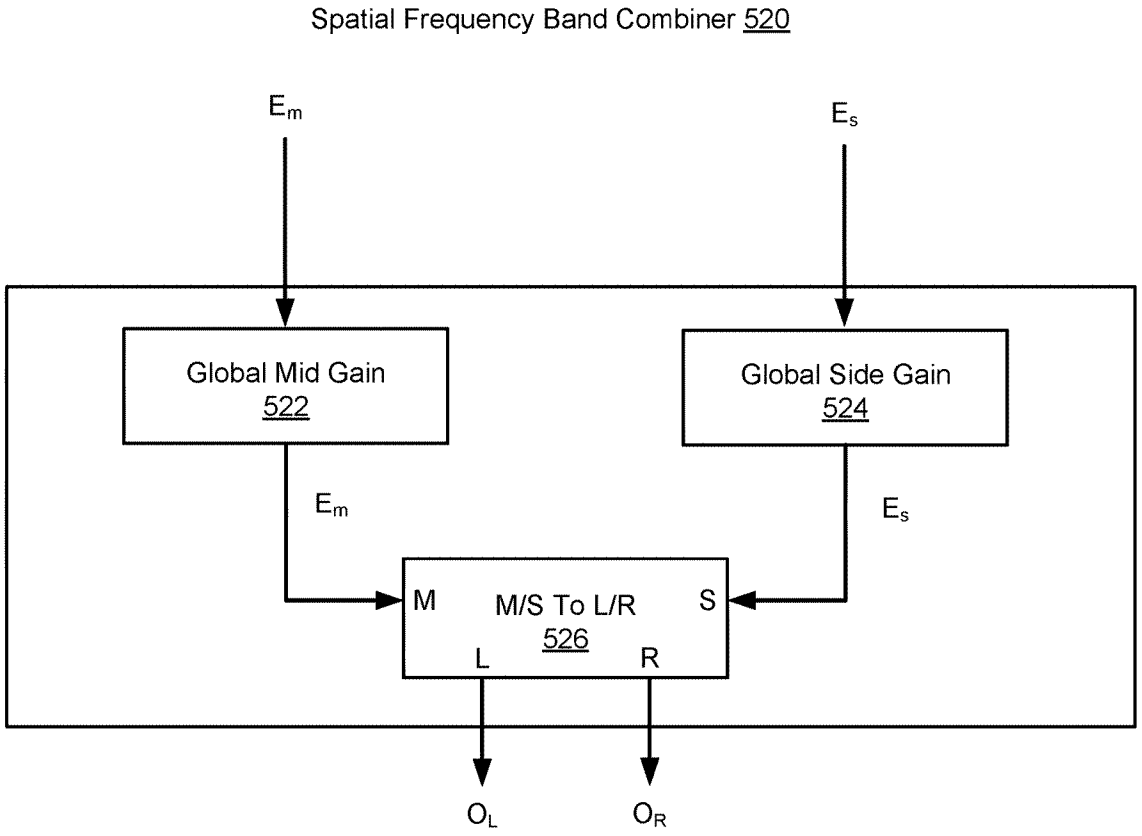
FIG. 5C illustrates an example of a spatial frequency band combiner of the audio system, according to some embodiments.

FIG. 5C illustrates a third example of a spatial frequency band combiner 520, as an implementation of the frequency band combiner 250 of the subband spatial processor 210. The spatial frequency band combiner 520 receives the enhanced nonspatial component $E_m$ and the enhanced spatial component $E_s$ (e.g., rather than their separated subband components), and performs global mid and side gains before converting the enhanced nonspatial component $E_m$ and the enhanced spatial component $E_s$ into the left output channel $O_L$ and the right output channel $O_R$.

More specifically, the spatial frequency band combiner 520 includes a global mid gain 522, a global side gain 524, and an M/S to L/R converter 526 coupled to the global mid gain 522 and the global side gain 524. The global mid gain 522 receives the enhanced nonspatial component $E_m$ and applies a gain, and the global side gain 524 receives the enhanced spatial component $E_s$ and applies a gain. The M/S to L/R converter 526 receives the enhanced nonspatial component $E_m$ from the global mid gain 522 and the enhanced spatial component $E_s$ from the global side gain 524, and converts these inputs into the left output channel $O_L$ and the right output channel $O_R$.

Figure 5D:
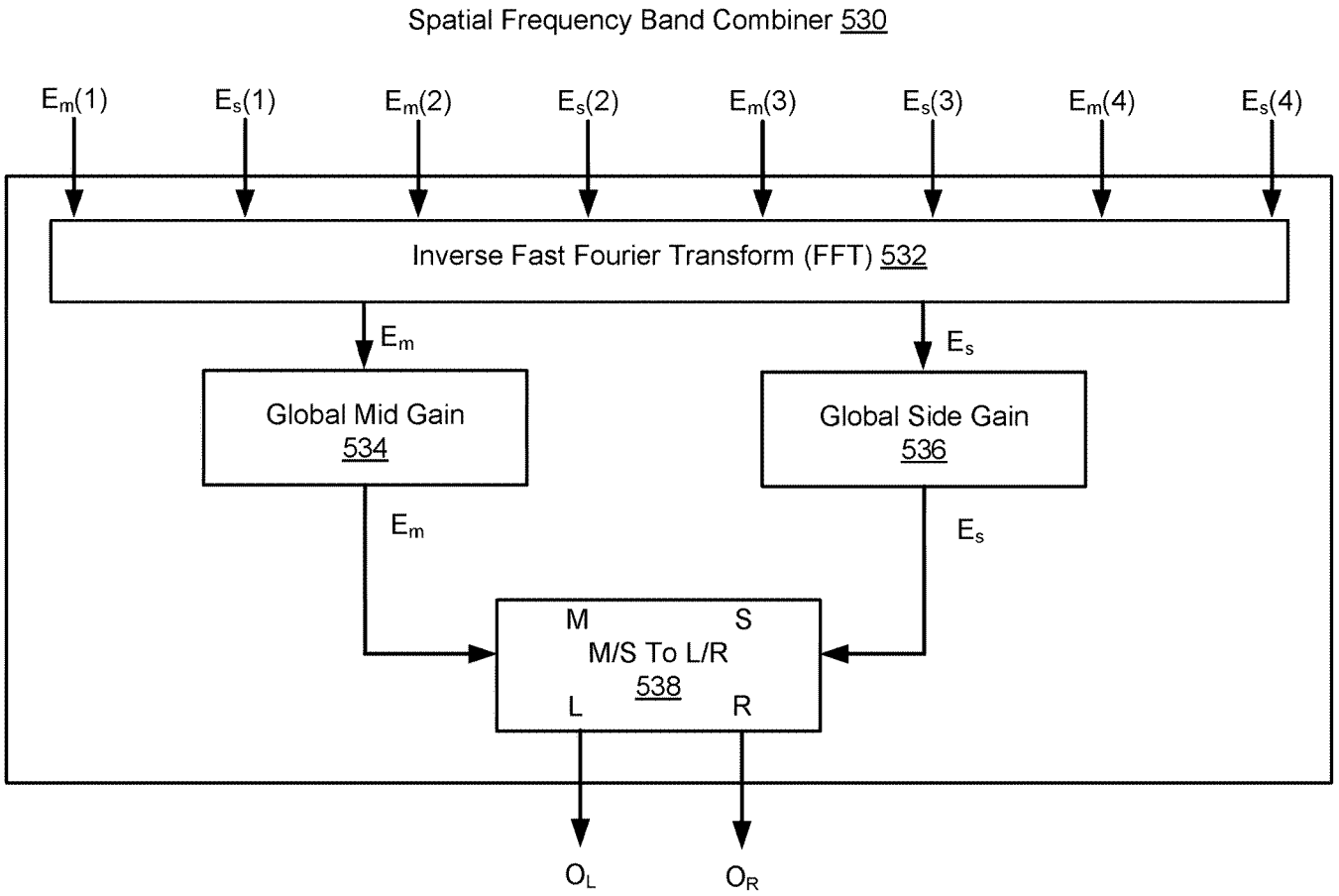
FIG. 5D illustrates an example of a spatial frequency band combiner of the audio system, according to some embodiments.

FIG. 5D illustrates a fourth example of spatial frequency band combiner 530 as an implementation of the frequency band combiner 250 of the subband spatial processor 210. The spatial frequency band combiner 530 facilitates frequency domain enhancement of the input audio signal.

More specifically, the spatial frequency band combiner 530 includes an inverse fast Fourier transform (FFT) 532, a global mid gain 534, a global side gain 536, and an M/S to L/R converter 538. The inverse FFT 532 receives the enhanced nonspatial subband components $E_m(\mathbf{1})$-$E_m(n)$ as represented in the frequency domain, and receives the enhanced spatial subband components $E_s(\mathbf{1})$-$E_s(n)$ as represented in the frequency domain. The inverse FFT 532 converts the frequency domain inputs into the time domain. The inverse FFT 532 then combines the enhanced nonspatial subband components $E_m(\mathbf{1})$-$E_m(n)$ into the enhanced nonspatial component $E_m$ as represented in the time domain, and combines the enhanced spatial subband components $E_s(\mathbf{1})$-$E_s(n)$ into the enhanced spatial component $E_s$ as represented in the time domain. In other embodiments, inverse FFT 532 combines subband components in the frequency domain, then converts the combined enhanced nonspatial component $E_m$ and enhanced spatial component $E_s$ into the time domain.

The global mid gain 534 is coupled to the inverse FFT 532 to receive the enhanced nonspatial component $E_m$ and apply a gain to the enhanced nonspatial component $E_m$. The global side gain 536 is coupled to the inverse FFT 532 to receive the enhanced spatial component $E_s$ and apply a gain to the enhanced spatial component $E_s$. The M/S to L/R converter 538 receives the enhanced nonspatial component $E_m$ from the global mid gain 534 and the enhanced spatial component $E_s$ from the global side gain 536, and converts these inputs into the left output channel $O_L$ and the right output channel $O_R$. The global gain values can be controlled by configuration information, adjustable settings, etc.

Figure 6:
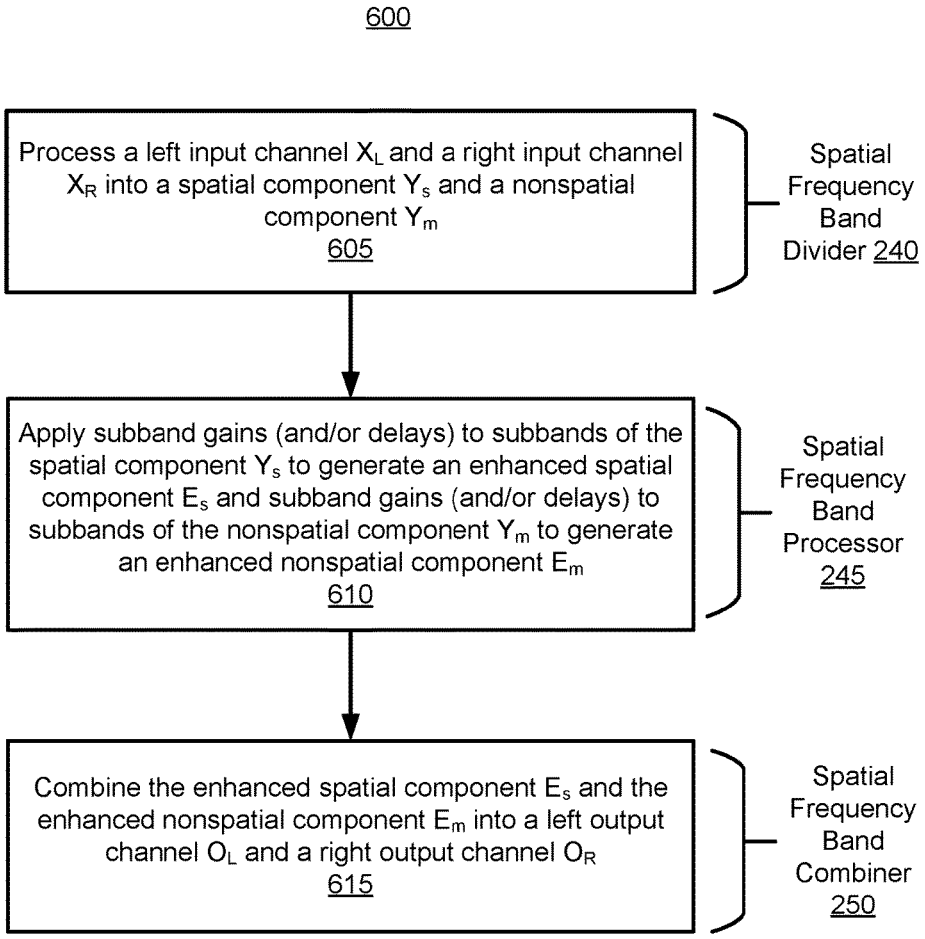
FIG. 6 illustrates an example of a method for enhancing an audio signal, according to one embodiment.

FIG. 6 illustrates an example of a method 600 for enhancing an audio signal, according to one embodiment. The method 600 can be performed by the subband spatial processor 210, including the spatial frequency band divider 240, the spatial frequency band processor 245, and the spatial frequency band combiner 250 to enhance an input audio signal include a left input channel $X_L$ and a right input channel $X_R$.

The spatial frequency band divider 240 separates 605 the left input channel $X_L$ and the right input channel $X_R$ into a spatial component $Y_s$ and a nonspatial component $Y_m$. In some embodiments, spatial frequency band divider 240 separates the spatial component $Y_s$ into n subband components $Y_s(1)$-$Y_s(n)$ and separates the nonspatial component $Y_m$ into n subband components $Y_m(1)$-$Y_m(n)$.

The spatial frequency band processor 245 applies 610 subband gains (and/or time delays) to subbands of the spatial component $Y_s$ to generate an enhanced spatial component $E_s$, and applies subband gains (and/or delays) to subbands of the nonspatial component $Y_m$ to generate an enhanced nonspatial component $E_m$.

In some embodiments, the spatial frequency band processor 460 of FIG. 4C applies a series of subband filters to the spatial component $Y_s$ and the nonspatial component $Y_m$ to generate the enhanced spatial component $E_s$ and the enhanced nonspatial component $E_m$. The gains for the spatial component $Y_s$ can be applied to the subbands with a series of n subband filters. Each filter applies a gain to one of the n subbands of the spatial component $Y_s$. The gains for the nonspatial component $Y_m$ can also be applied to the subbands with a series of filters. Each filter applies a gain to one of the n subbands of the nonspatial component $Y_m$.

In some embodiments, the spatial frequency band processor 400 of FIG. 4A or the spatial frequency band processor 420 of FIG. 4B applies gains to separated subband components in parallel. For example, the gains for the spatial component $Y_s$ can be applied to the subbands with a parallel set of n subband filters for the separated spatial subband components $Y_s(1)$-$Y_s(n)$, resulting in the enhanced spatial component $E_s$ being represented as the enhanced spatial subband components $E_s(1)$-$E_s(n)$. The gains for the nonspatial component $Y_m$ can be applied to the subbands with a parallel set of n filters for the separated nonspatial subband components $Y_m(1)$-$Y_m(n)$, resulting in the enhanced nonspatial component $E_m$ being represented as the enhanced nonspatial subband components $E_m(1)$-$E_m(n)$.

The spatial frequency combiner 250 combines 615 the enhanced spatial component $E_s$ and the enhanced nonspatial component $E_m$ into the left output channel $O_L$ and the right output channel $O_R$. In embodiments such as the spatial frequency combiner shown in FIG. 5A, 5B, or 5D, where the spatial component $E_s$ is represented by the separated enhanced spatial subband components $E_s(1)$-$E_s(n)$, the spatial frequency combiner 250 combines the enhanced spatial subband components $E_s(1)$-$E_s(n)$ into the spatial component $E_s$. Similarly, if the nonspatial component $E_m$ is represented by the separated enhanced nonspatial subband components $E_m(1)$-$E_m(n)$, the spatial frequency combiner 250 combines the enhanced nonspatial subband components $E_m(1)$-$E_m(n)$ into the nonspatial component $E_m$.

In some embodiments, the spatial frequency band combiner 250 (or processor 245) applies a global mid gain to the enhanced nonspatial component $E_m$ and a global side gain to the enhanced spatial component $E_s$ prior to combination into the left output channel $O_L$ and the right output channel $O_R$. The global mid and side gains adjust the relative gains of the enhanced spatial component $E_s$ and the enhanced nonspatial component $E_m$.

Various embodiments of the spatial frequency band divider 240 (e.g., as shown by the spatial frequency band dividers 300, 310, 320, and 330 of FIGS. 3A, 3B, 3C, and 3D, respectively), the spatial frequency band processor 245 (e.g., as shown by the spatial frequency band processors 400, 420, and 460 of FIGS. 4A, 4B, and 4C, respectively), and the spatial frequency band combiner 250 (e.g., as shown by the spatial frequency band combiners 500, 510, 520, and 530 of FIGS. 5A, 5B, 5C, and 5D, respectively) may be combined with each other. Some example combinations are discussed in greater detail below.

Figure 7:
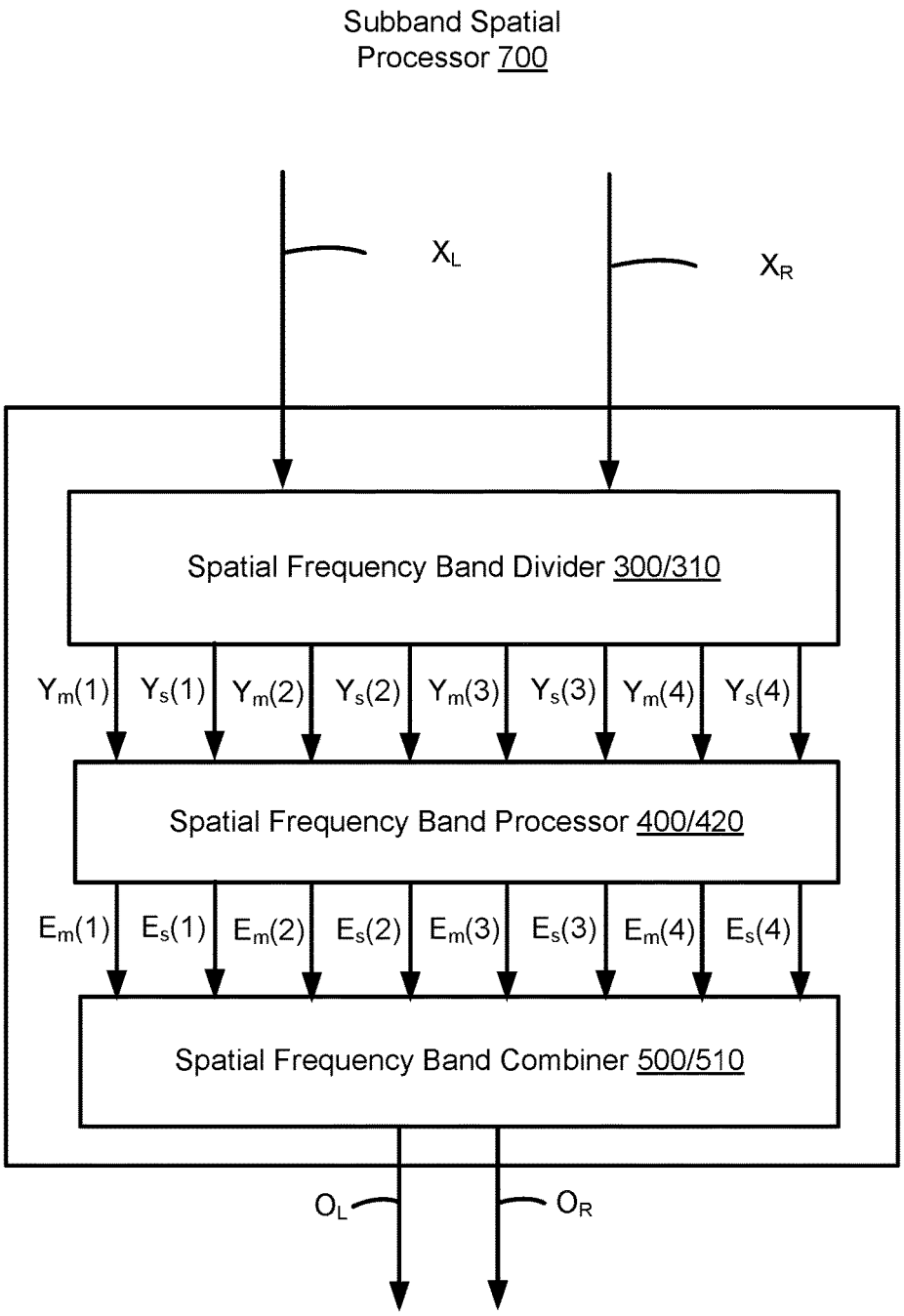
FIG. 7 illustrates an example of a subband spatial processor, according to one embodiment.

FIG. 7 illustrates an example of a subband spatial processor 700, according to one embodiment. The subband spatial processor 700 is an example of a subband spatial processor 210. The subband spatial processor 700 uses separated spatial subband components $Y_s(1)$-$Y_s(n)$ and nonspatial subband components $Y_m(1)$-$Y_m(n)$, and n=4 frequency subbands. The subband spatial processor 700 includes either spatial frequency band divider 300 or 310, either the spatial frequency band processor 400 or 420, and either the spatial frequency band combiner 500 or 510.

Figure 8:
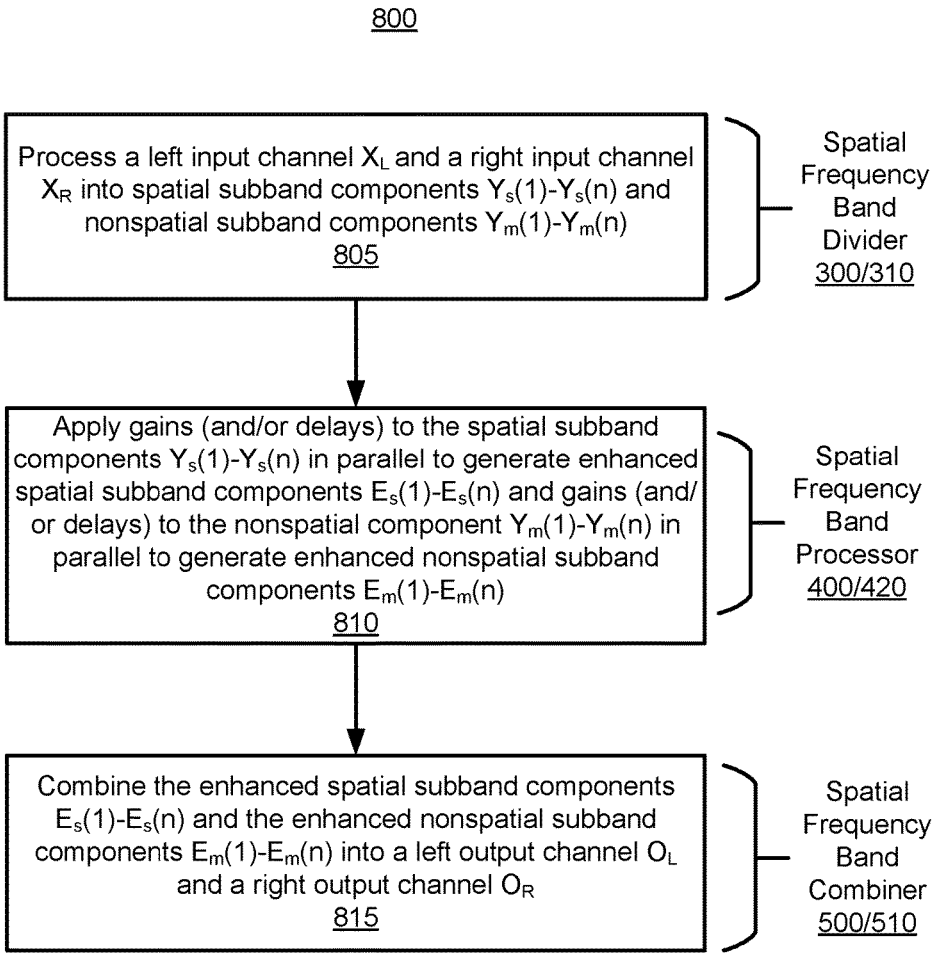
FIG. 8 illustrates an example of a method for enhancing an audio signal with the subband spatial processor shown in FIG. 7, according to one embodiment.

FIG. 8 illustrates an example of a method 800 for enhancing an audio signal with the subband spatial processor 700 shown in FIG. 7, according to one embodiment. The spatial frequency band divider 300/310 processes 805 the left input channel $X_L$ and the right input channel $X_R$ into the spatial subband components $Y_s(1)$-$Y_s(n)$ and the nonspatial subband components $Y_m(1)$-$Y_m(n)$. The frequency band divider 300 separates frequency subbands, then performs L/R to M/S conversion. The frequency band divider 310 performs L/R to M/S conversion, then separates frequency subbands.

The spatial frequency band processor 400/420 applies 810 gains (and/or delays) to the spatial subband components $Y_s(1)$-$Y_s(n)$ in parallel to generate the enhanced spatial subband components $E_s(1)$-$E_s(n)$, and applies gains (and/or delays) to the nonspatial subband components $Y_m(1)$-$Y_m(n)$ in parallel to generate the enhanced nonspatial subband components $E_m(1)$-$E_m(n)$. The spatial frequency band processor 400 can apply subband gains, while the spatial frequency band processor 420 can apply subband gains and/or time delays.

The spatial frequency band combiner 500/510 combines 815 the enhanced spatial subband components $E_s(1)$-$E_s(n)$ and the enhanced nonspatial subband components $E_m(1)$-$E_m(n)$ into the left output channel $O_L$ and the right output channel $O_R$. The spatial frequency band combiner 500 performs M/S to L/R conversion, then combines left and right subbands. The spatial frequency band combiner 510 combines nonspatial (mid) and spatial (side) subbands, applies global mid and side gains, then performs M/S to L/R conversion.

Figure 9:
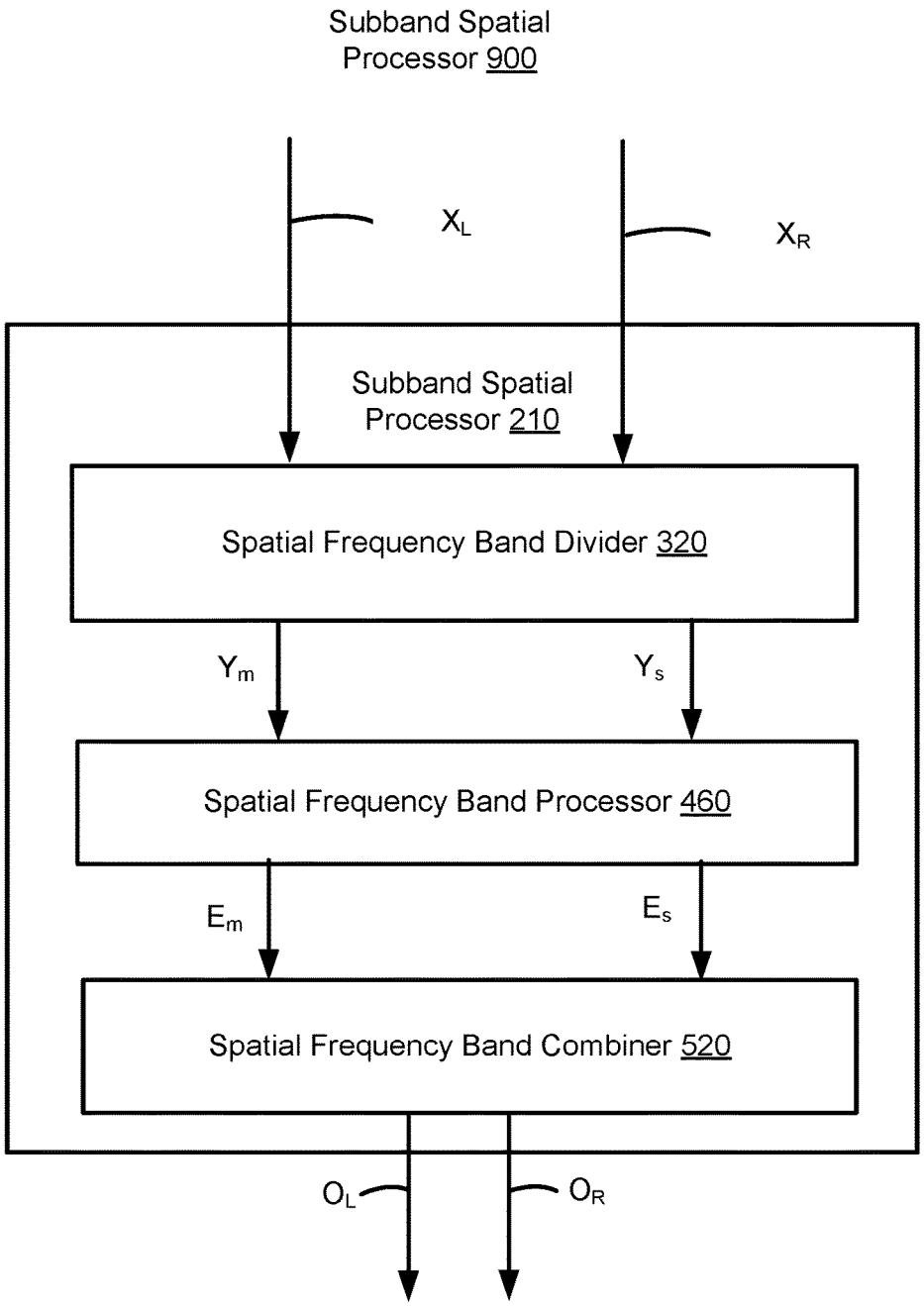
FIG. 9 illustrates an example of a subband spatial processor, according to one embodiment.

FIG. 9 illustrates an example of a subband spatial processor 900, according to one embodiment. The subband spatial processor 900 is an example of a subband spatial processor 210. The subband spatial processor 900 uses the spatial component $Y_s$ and the nonspatial component $Y_m$ without separation into subband components. The subband spatial processor 900 includes the spatial frequency band divider 320, the spatial frequency band processor 460, and the spatial frequency band combiner 520.

Figure 10:
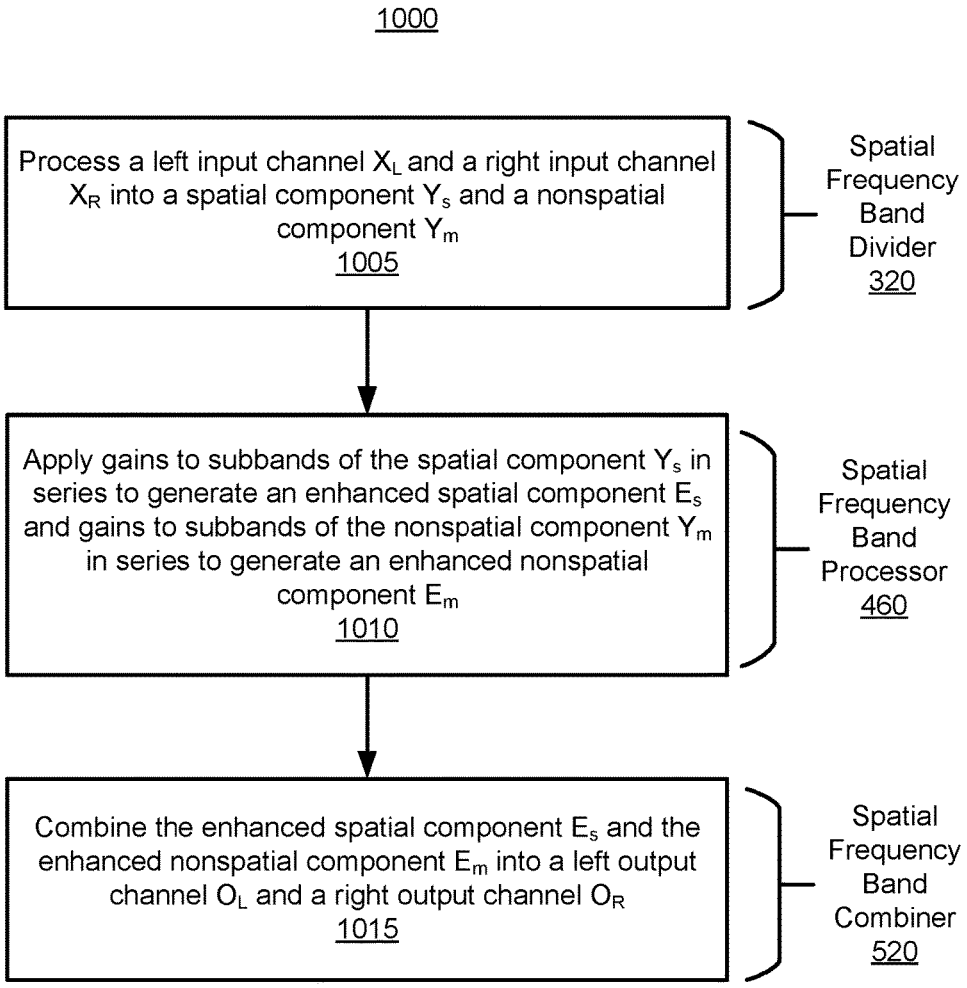
FIG. 10 illustrates an example of a method for enhancing an audio signal with the subband spatial processor shown in FIG. 9, according to one embodiment.

FIG. 10 illustrates an example of a method 1000 for enhancing an audio signal with the subband spatial processor 900 shown in FIG. 9, according to one embodiment. The spatial frequency band divider 320 processes 1005 the left input channel $X_L$ and the right input channel $X_R$ into the spatial component $Y_s$ and the nonspatial components $Y_m$.

The spatial frequency band processor 460 applies 1010 gains to subbands of the spatial component $Y_s$ in series to generate the enhanced spatial component $E_s$, and gains to subbands of the nonspatial component $Y_m$ in series to generate the enhanced nonspatial component $E_m$. A first series of n mid EQ filters are applied to the nonspatial component $Y_m$, each mid EQ filter corresponding with one of the n subbands. A second series of n side EQ filters are applied to the spatial component $Y_s$, each side EQ filter corresponding with one of the n subbands.

The spatial frequency band combiner 520 combines 815 the enhanced spatial component $E_s$ and the enhanced nonspatial component $E_m$ into the left output channel $O_L$ and the right output channel $O_R$. In some embodiments, the spatial frequency band combiner 520 applies a global side gain to the enhanced spatial component $E_s$, and applies global mid gain to the enhanced nonspatial component $E_m$, and then combines $E_s$ and $E_m$ into the left output channel $O_L$ and the right output channel $O_R$.

Figure 11:
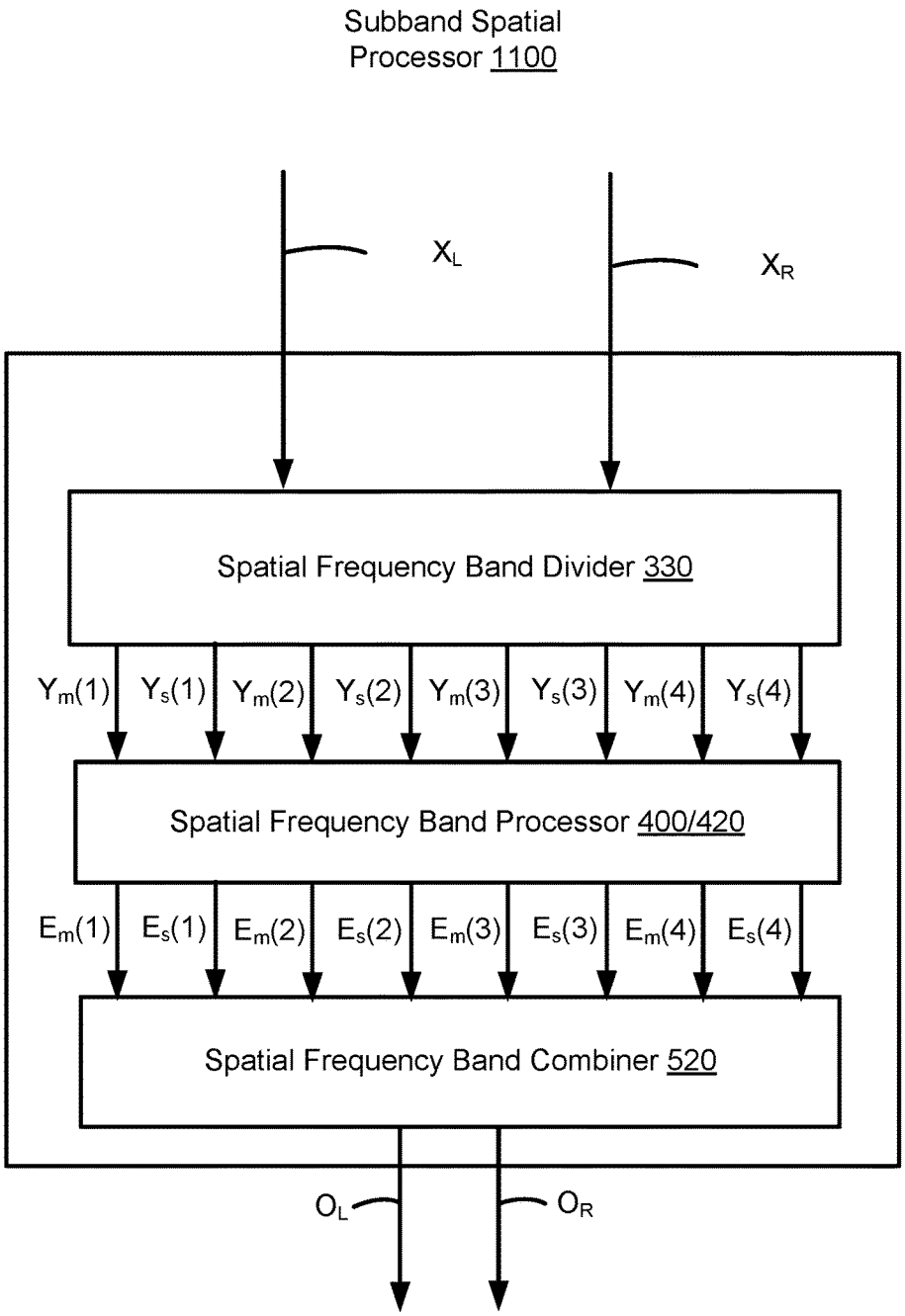
FIG. 11 illustrates an example of a subband spatial processor, according to one embodiment.

FIG. 11 illustrates an example of a subband spatial processor 1100, according to one embodiment. The subband spatial processor 1100 is another example of a subband spatial processor 210. The subband spatial processor 1100 uses conversion between the time domain and frequency domain, with gains being adjusted to frequency subbands in the frequency domain. The subband spatial processor 1100 includes the spatial frequency band divider 330, the spatial frequency band processor 400 or 420, and the spatial frequency band combiner 520.

Figure 12:
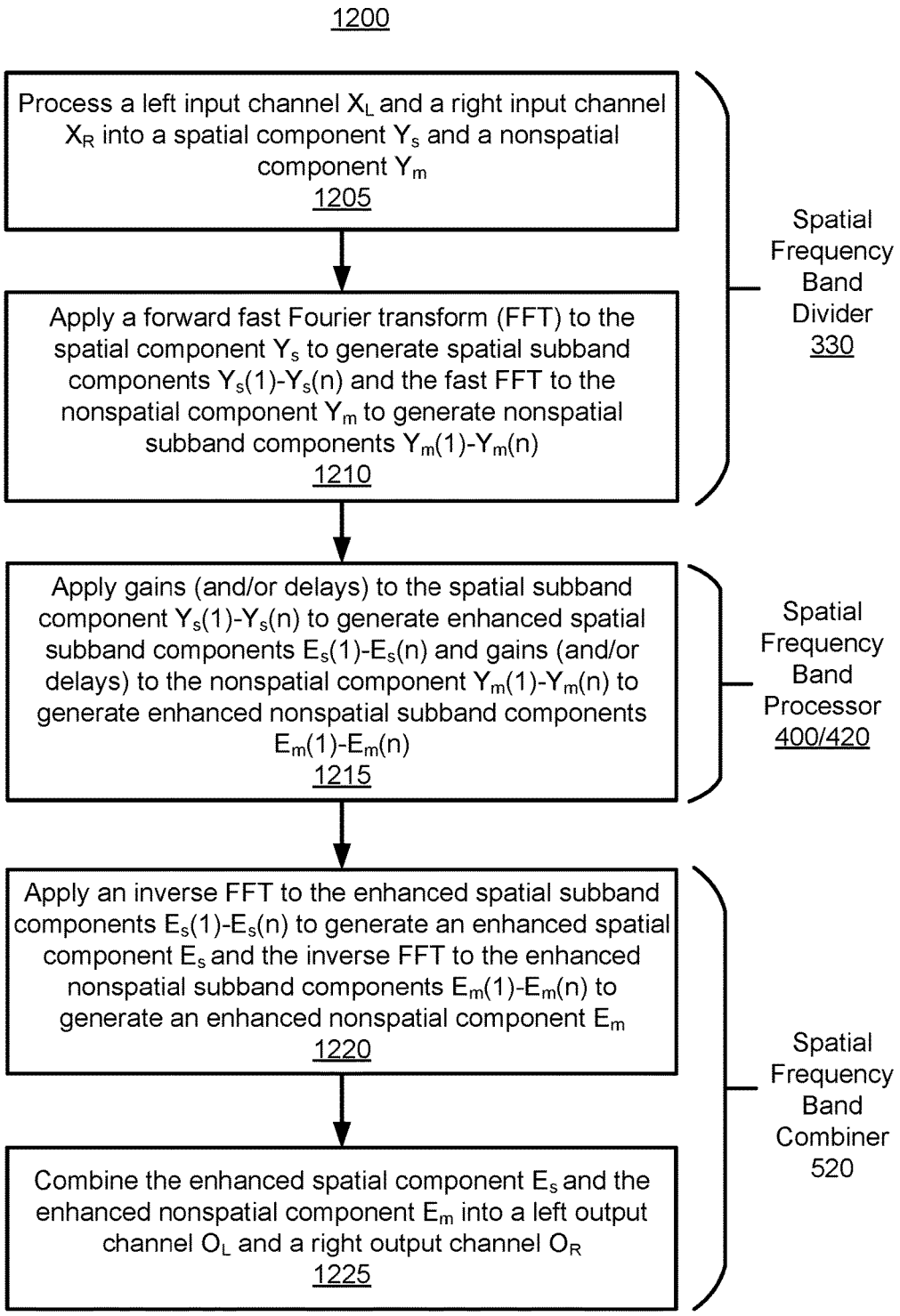
FIG. 12 illustrates an example of a method for enhancing an audio signal with the subband spatial processor shown in FIG. 11, according to one embodiment.

FIG. 12 illustrates an example of a method 1200 for enhancing an audio signal with the subband spatial processor 1100 shown in FIG. 11, according to one embodiment. The spatial frequency band divider 330 processes 1205 the left input channel $X_L$ and the right input channel $X_R$ into the spatial component $Y_s$ and the nonspatial components $Y_m$.

The spatial frequency band divider 330 applies 1210 a forward FFT to the spatial component $Y_s$ to generate spatial subband components $Y_s(1)$-$Y_s(n)$ (e.g., n=4 frequency subbands as shown in FIG. 11), and applies the forward FFT to the nonspatial component $Y_m$ to generate nonspatial subband components $Y_m(1)$-$Y_m(n)$. In addition to separation into frequency subbands, the frequency subbands are converted from the time domain to the frequency domain.

The spatial frequency band processor 400/420 applies 1215 gains (and/or delays) to the spatial subband components $Y_s(1)$-$Y_s(n)$ in parallel to generate the enhanced spatial subband components $E_s(1)$-$E_s(n)$, and applies gains (and/or delays) to the nonspatial subband components $Y_m(1)$-$Y_m(n)$ in parallel to generate the enhanced nonspatial subband components $E_m(1)$-$E_m(n)$. The gains and/or delays are applied to signals represented in the frequency domain.

The spatial frequency band combiner 520 applies 1220 an inverse FFT to the enhanced spatial subband components $E_s(1)$-$E_s(n)$ to generate the enhanced spatial component $E_s$, and applies the inverse FFT to the enhanced nonspatial subband components $E_m(1)$-$E_m(n)$ to generate the enhanced nonspatial component $E_m$. The inverse FFT results in the enhanced spatial component $E_s$ and the enhanced nonspatial component $E_m$ being represented in the time domain.

The spatial frequency band combiner 520 combines 1225 the enhanced spatial component $E_s$ and the enhanced nonspatial component $E_m$ into the left output channel $O_L$ and the right output channel $O_R$. In some embodiments, the spatial frequency band combiner 520 applies a global mid gain to the enhanced nonspatial component $E_m$ and a global side gain to the enhanced spatial component $E_s$, and then generates the output channels $O_L$ and $O_R$.

Figure 13:
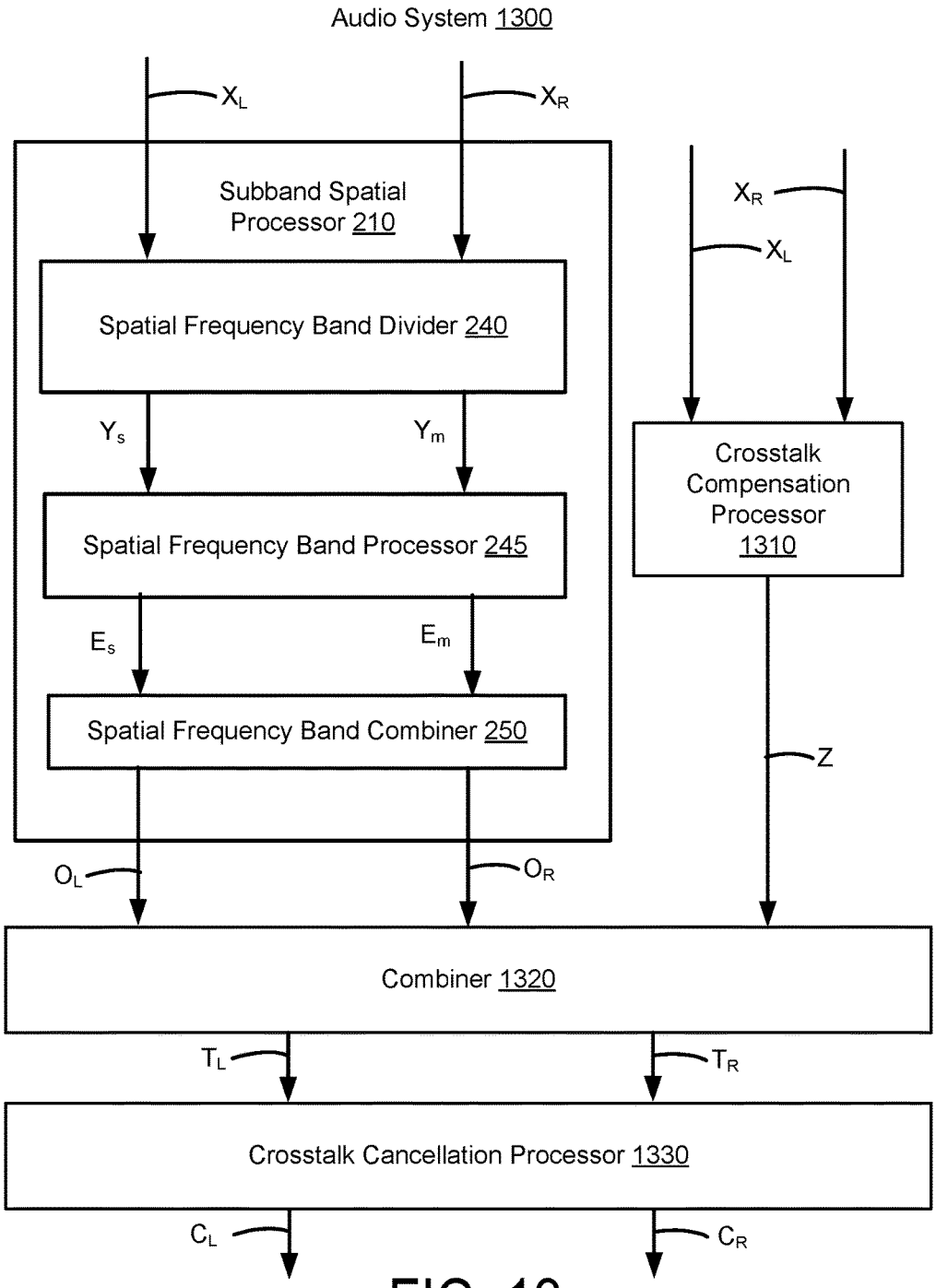
FIG. 13 illustrates an example of an audio system 1300 for enhancing an audio signal with crosstalk cancellation, according to one embodiment.

FIG. 13 illustrates an example of an audio system 1300 for enhancing an audio signal with crosstalk cancellation, according to one embodiment. The audio system 1300 can be used with loudspeakers to cancel contralateral crosstalk components of the left output channel $O_L$ and the right output channel $O_R$. The audio system 1300 includes the subband spatial processor 210, a crosstalk compensation processor 1310, a combiner 1320, and a crosstalk cancellation processor 1330.

The crosstalk compensation processor 1310 receives the input channels $X_L$ and $X_R$, and performs a preprocessing to precompensate for any artifacts in a subsequent crosstalk cancellation performed by the crosstalk cancellation processor 1330. In particular, the crosstalk compensation processor 1310 generates a crosstalk compensation signal Z in parallel with the subband spatial processor 210 generating the left output channel $O_L$ and the right output channel $O_R$. In some embodiments, the crosstalk compensation processor 1310 generates spatial and nonspatial components from the input channels $X_L$ and $X_R$, and applies gains and/or delays to the nonspatial and spatial components to generate the crosstalk compensation signal Z.

The combiner 1320 combines the crosstalk compensation signal Z with each of left output channel $O_L$ and the right output channel $O_R$ to generate a precompensated signal T comprising two precompensated channels $T_L$ and $T_R$.

The crosstalk cancellation processor 1330 receives the precompensated channels $T_L$, $T_R$, and performs crosstalk cancellation on the channels $T_L$, $T_R$ to generate an output audio signal C comprising left output channel $C_L$ and right output channel $C_R$. Alternatively, the crosstalk cancellation processor 1330 receives and processes the left and right output channels $O_L$ and $O_R$ without crosstalk precompensation. Here, crosstalk compensation can be applied to the left and right output channels $C_L$, $C_R$ subsequent to crosstalk cancellation. The crosstalk cancellation processor 1330 separates the precompensated channels $T_L$, $T_R$ into inband components and out of band components, and perform a crosstalk cancellation on the inband components to generate the output channels $C_L$, $C_R$.

In some embodiments, the crosstalk cancellation processor 1330 receives the input channels $X_L$ and $X_R$ and performs crosstalk cancellation on the input channels $X_L$ and $X_R$. Here, crosstalk cancellation is performed on the input signal X rather than the output signal O from the subband spatial processor 210. In some embodiments, the crosstalk cancellation processor 1330 performs crosstalk cancellation on both the input channels $X_L$ and $X_R$ and the output channels $O_L$ and $O_R$ and combines these results (e.g., with different gains) to generate the output channels $C_L$, $C_R$.

Figure 14:
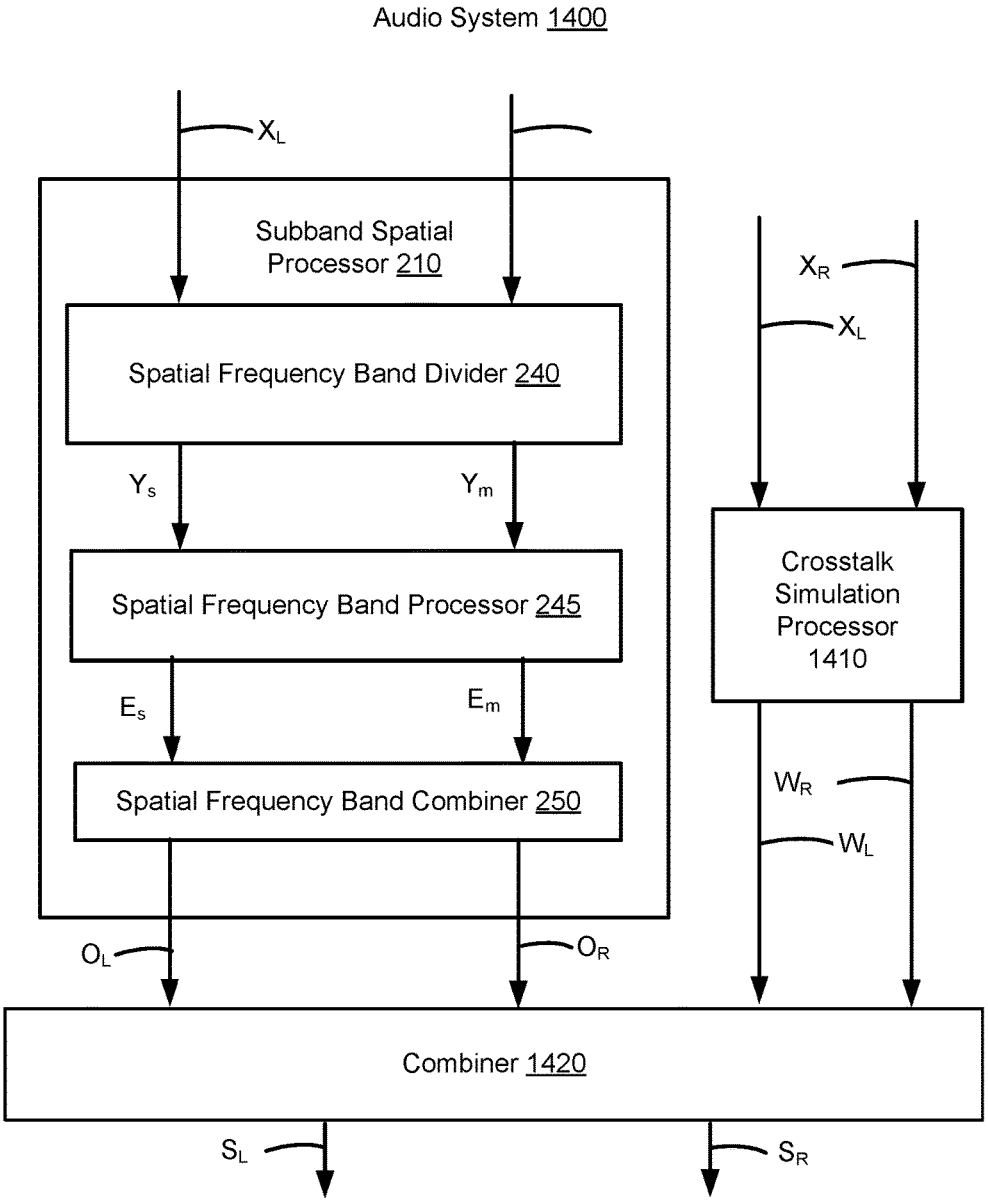
FIG. 14 illustrates an example of an audio system 1400 for enhancing an audio signal with crosstalk simulation, according to one embodiment.

FIG. 14 illustrates an example of an audio system 1400 for enhancing an audio signal with crosstalk simulation, according to one embodiment. The audio system 1400 can be used with headphones to add contralateral crosstalk components to the left output channel $O_L$ and the right output channel $O_R$. This allows headphones to simulate the listening experience of loudspeakers. The audio system 1400 includes the subband spatial processor 210, a crosstalk simulation processor 1410, and a combiner 1420.

The crosstalk simulation processor 1410 generates a "head shadow effect" from the audio input signal X. The head shadow effect refers to a transformation of a sound wave caused by trans-aural wave propagation around and through the head of a listener, such as would be perceived by the listener if the audio input signal X was transmitted from loudspeakers to each of the left and right ears of a listener. For example, the crosstalk simulation processor 1410 generates a left crosstalk channel $W_L$ from the left channel $X_L$ and a right crosstalk channel $W_R$ from the right channel $X_R$. The left crosstalk channel $W_L$ may be generated by applying a low-pass filter, delay, and gain to the left input channel $X_L$. The right crosstalk channel $W_R$ may be generated by applying a low-pass filter, delay, and gain to the right input channel $X_R$. In some embodiments, low shelf filters or notch filters may be used rather than low-pass filters to generate the left crosstalk channel $W_L$ and right crosstalk channel $W_R$.

The combiner 1420 combines the output of the subband spatial processor 210 and the crosstalk simulation processor 1410 to generate an audio output signal S that includes left output signal $S_L$ and right output signal $S_R$. For example, the left output channel $S_L$ includes a combination of the enhanced left channel $O_L$ and the right crosstalk channel $W_R$(e.g., representing the contralateral signal from a right loudspeaker that would be heard by the left ear via trans-aural sound propagation). The right output channel $S_R$ includes a combination of the enhanced right channel $O_R$ and the left crosstalk channel $W_L$ (e.g., representing the contralateral signal from a left loudspeaker that would be heard by the right ear via trans-aural sound propagation). The relative weights of the signals input to the combiner 1420 can be controlled by the gains applied to each of the inputs.

In some embodiments, the crosstalk simulation processor 1410 generates the crosstalk channels $W_L$ and $W_R$ from the left and right output channels $O_L$ and $O_R$ of the subband spatial processor 210 instead of the input channels $X_L$ and $X_R$. In some embodiments, the crosstalk simulation processor 1410 generates crosstalk channels from both the left and right output channels $O_L$ and $O_R$ and the input channels $X_L$ and $X_R$, and combines these results (e.g., with different gains) to generate the left output signal $S_L$ and right output signal $S_R$.

Upon reading this disclosure, those of skill in the art will appreciate still additional alternative embodiments of the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

Any of the steps, operations, or processes described herein may be performed or implemented with one or more hardware or software modules, alone or in combination with other devices. In one embodiment, a software module is implemented with a computer program product comprising a computer readable medium (e.g., non-transitory computer readable medium) containing computer program code, which can be executed by a computer processor for performing any or all of the steps, operations, or processes described.

What is claimed is:

1. A method for enhancing an audio signal having a left input channel and a right input channel, comprising:

processing the left input channel and the right input channel into a spatial component and a nonspatial component, the spatial component including a difference between the left input channel and the right input channel and the nonspatial component including a sum of the left input channel and the right input channel;

applying first subband gains to subbands of the spatial component to generate an enhanced spatial component, wherein applying the first subband gains to the subbands of the spatial component includes applying a first set of subband filters to the spatial component;

applying second subband gains to subbands of the nonspatial component to generate an enhanced nonspatial component, wherein applying the second subband gains to the subbands of the nonspatial component includes applying a second set of subband filters to the nonspatial component; and combining the enhanced spatial component and the enhanced nonspatial component into a left output channel and a right output channel.

2. The method of claim 1, wherein:

processing the left input channel and the right input channel into the spatial component and the nonspatial component includes processing the left input channel and the right input channel into spatial subband components and nonspatial subband components;

applying the first subband gains to the subbands of the spatial component to generate the enhanced spatial component includes applying the first subband gains to the spatial subband components to generate enhanced spatial subband components;

applying the second gains to the subbands of the nonspatial component to generate the enhanced spatial component includes applying the second subband gains to the nonspatial subband components to generate enhanced nonspatial subband components; and combining the enhanced spatial component and the enhanced nonspatial component into the left output channel and the right output channel includes combining the enhanced spatial subband components and the enhanced nonspatial subband components.

3. The method of claim 2, wherein processing the left input channel and the right input channel into spatial subband components and nonspatial subband components includes:

processing the left input channel and the right input channel into left subband components and right subband components; and converting the left subband components and the right subband components into the spatial subband components and nonspatial subband components.

4. The method of claim 2, wherein processing the left input channel and the right input channel into spatial subband components and nonspatial subband components includes:

converting the left input channel and the right input channel into the spatial component and the nonspatial component; and processing the spatial component and the nonspatial component into the spatial subband components and the nonspatial subband components.

5. The method of claim 2, wherein:

processing the left input channel and the right input channel into the spatial subband components and the nonspatial subband components includes:

converting the left input channel and the right input channel into the spatial component and the nonspatial component;

applying a forward fast Fourier transform (FFT) to the spatial component to generate the spatial subband components; and applying the forward FFT to the nonspatial component to generate the nonspatial subband components; and the method further includes, prior to combining the enhanced spatial component and the enhanced nonspatial component:

applying an inverse FFT to the enhanced spatial subband components to generate the enhanced spatial component; and applying the inverse FFT to the enhanced nonspatial subband components to generate the enhanced nonspatial component.

6. The method of claim 2, wherein the first subband gains are applied to the spatial subband components in parallel and the second subband gains are applied to the nonspatial subband components in parallel.

7. The method of claim 2, wherein combining the enhanced spatial subband components and the enhanced nonspatial subband components includes:

processing the enhanced spatial subband components and the enhanced nonspatial subband components into enhanced left subband components and enhanced right subband components; and combining the enhanced left subband components into the left output channel and the enhanced right subband components into the right output channel.

8. The method of claim 2, wherein combining the enhanced spatial component and the enhanced nonspatial component into the left output channel and the right output channel includes:

combining the enhanced spatial subband components into the enhanced spatial component and the enhanced nonspatial subband components into the enhanced nonspatial component; and converting the enhanced spatial component and the enhanced nonspatial component into the left output channel and the right output channel.

9. The method of claim 1, further comprising:

applying time delays to the subbands of the spatial component to generate the enhanced spatial component; and applying time delays to the subbands of the nonspatial component to generate an enhanced nonspatial component.

10. The method of claim 1, wherein:

the first set of subband filters includes a first series of subband filters including a subband filter for each of the subbands of the spatial component; and the second set of filters includes a second series of subband filters including a subband filter for each of the subbands of the nonspatial component.

11. The method of claim 1, further comprising, prior to combining the enhanced spatial component and the enhanced nonspatial component, applying a first gain to the enhanced spatial component and a second gain to the enhanced nonspatial component.

12. The method of claim 1, further comprising applying crosstalk cancellation to at least one of:

the left output channel and the right output channel; and the left input channel and the right input channel.

13. The method of claim 1, further comprising applying crosstalk simulation to at least one of:

the left output channel and the right output channel; and the left input channel and the right input channel.

14. A system for enhancing an audio signal having a left input channel and a right input channel, comprising:

a spatial frequency band divider configured to process the left input channel and the right input channel into a spatial component and a nonspatial component, the spatial component including a difference between the left input channel and the right input channel and the nonspatial component including a sum of the left input channel and the right input channel;

a spatial frequency band processor including:

a first set of subband filters configured to apply first subband gains to subbands of the spatial component to generate an enhanced spatial component; and a second set of subband filters configured to apply second subband gains to subbands of the nonspatial component to generate an enhanced nonspatial component; and a spatial frequency band combiner configured to combine the enhanced spatial component and the enhanced nonspatial component into a left output channel and a right output channel.

15. The system of claim 14, wherein:

the spatial frequency band divider configured to process the left input channel and the right input channel into the spatial component and the nonspatial component includes the spatial frequency band divider being configured to process the left input channel and the right input channel into spatial subband components and nonspatial subband components;

the spatial frequency band processor configured to apply the first subband gains to the subbands of the spatial component to generate the enhanced spatial component includes the spatial frequency band processor being configured to apply the first subband gains to the spatial subband components to generate enhanced spatial subband components;

the spatial frequency band processor configured to apply the second subband gains to the subbands of the nonspatial component to generate the enhanced nonspatial component includes the spatial frequency band processor being configured to apply the second subband gains to the nonspatial subband components to generate enhanced nonspatial subband components; and the spatial frequency band combiner configured to combine the enhanced spatial component and the enhanced nonspatial component into the left output channel and the right output channel includes the spatial frequency band combiner being configured to combine the enhanced spatial subband components and the enhanced nonspatial subband components.

16. The system of claim 15, wherein the spatial frequency band divider includes:

a crossover network configured to process the left input channel and the right input channel into left subband components and right subband components; and L/R to M/S converters configured to convert the left subband components and the right subband components into the spatial subband components and nonspatial subband components.

17. The system of claim 15, wherein the spatial frequency band divider includes:

L/R to M/S converters configured to convert the left input channel and the right input channel into the spatial component and the nonspatial component; and a crossover network configured to process the spatial component into the spatial subband components and the nonspatial component into the nonspatial subband components.

18. The system of claim 15, wherein:

the spatial frequency band divider includes:

a L/R to M/S converter configured to convert the left input channel and the right input channel into the spatial component and the nonspatial component; and a forward fast Fourier transform (FFT) configured to:

apply a forward FFT to the spatial component to generate the spatial subband components; and apply the forward FFT to the spatial component to generate the spatial subband components; and the spatial frequency band combiner includes:

an inverse FFT configured to, prior to the spatial frequency band combiner combining the enhanced spatial component and the enhanced nonspatial component:

apply an inverse FFT to the enhanced spatial subband components to generate the enhanced spatial component; and apply the inverse FFT to the enhanced nonspatial subband components to generate the enhanced nonspatial component.

19. The system of claim 15, wherein the spatial frequency band processor includes:

a first set of amplifiers configured to apply the first subband gains to the spatial subband components in parallel; and a second set of amplifiers configured to apply the second subband gains to the nonspatial subband components in parallel.

20. The system of claim 15, wherein the spatial frequency band combiner being configured to combine the enhanced spatial subband components and the enhanced nonspatial subband components includes the spatial frequency band combiner being configured to:

process the enhanced spatial subband components and the enhanced nonspatial subband components into enhanced left subband components and enhanced right subband components; and combining the enhanced left subband components into the left output channel and the enhanced right subband components into the right output channel.

21. The system of claim 15, wherein the spatial frequency band combiner being configured to combine the enhanced spatial subband components and the enhanced nonspatial subband components includes the spatial frequency band combiner being configured to:

combine the enhanced spatial subband components into the enhanced spatial component and the enhanced nonspatial subband components into the enhanced nonspatial component; and convert the enhanced spatial subband component and the enhanced nonspatial component into the left output channel and the right output channel.

22. The system of claim 14, wherein the first set of subband filters are further configured to apply time delays to the subbands of the spatial component to generate the enhanced spatial component; and the second set of subband filters are further configured to apply time delays to the subbands of the nonspatial component to generate the enhanced nonspatial component.

23. The system of claim 14, wherein:

the first set of subband filters includes a first series of subband filters including a subband filter for each of the subbands of the spatial component; and the second set of subband filters includes a second series of subband filters including a subband filter for each of the subbands of the nonspatial component.

24. The system of claim 14, wherein the spatial frequency band combiner further includes:

a first amplifier configured to apply a first gain to the enhanced spatial component; and a second amplifier configured to apply a second gain to the enhanced nonspatial component.

25. The system of claim 14, further comprising a crosstalk cancellation processor configured to apply crosstalk cancellation to at least one of:

the left output channel and the right output channel; and the left input channel and the right input channel.

26. The system of claim 14, further comprising a crosstalk simulation processor configured to apply crosstalk simulation to at least one of:

the left output channel and the right output channel; and the left input channel and the right input channel.

27. A non-transitory computer readable medium configured to store program code, the program code comprising instructions that when executed by a processor cause the processor to:

process a left input channel and a right input channel of an audio signal into a spatial component and a nonspatial component, the spatial component including a difference between the left input channel and the right input channel and the nonspatial component including a sum of the left input channel and the right input channel;

apply first subband gains to subbands of the spatial component to generate an enhanced spatial component, wherein applying the first subband gains to the subbands of the spatial component includes applying a first set of subband filters to the spatial component;

apply second subband gains to subbands of the nonspatial component to generate an enhanced nonspatial component, wherein applying the second subband gains to the subbands of the nonspatial component includes applying a second set of subband filters to the nonspatial component; and combine the enhanced spatial component and the enhanced nonspatial component into a left output channel and a right output channel.

* * * * *